US005526880A

United States Patent [19]

Jordan, Jr. et al.

[11] Patent Number: 5,526,880

[45] Date of Patent: Jun. 18, 1996

[54] METHOD FOR MULTI-LATERAL COMPLETION AND CEMENTING THE JUNCTURE WITH LATERAL WELLBORES

[75] Inventors: Henry J. Jordan, Jr., Conroe; Robert J. McNair, The Woodlands; Rodney J. Bennett, Houston, all of Tex.

[73] Assignee: Baker Hughes Incorporated, Houston, Tex.

[21] Appl. No.: 306,497

[22] Filed: Sep. 15, 1994

[51] Int. Cl.[6] ..... E21B 33/00

[52] U.S. Cl. ..... 166/291; 166/313

[58] Field of Search ..... 166/285–287, 166/289–291, 381, 383, 386, 387, 313, 384, 50

[56] References Cited

U.S. PATENT DOCUMENTS

| | | | |
|---|---|---|---|
| 2,397,070 | 3/1946 | Zublin . | |
| 2,452,920 | 11/1948 | Gilbert . | |
| 2,797,893 | 7/1957 | McCune et al. . | |
| 2,858,107 | 10/1958 | Colmerauer . | |
| 3,330,349 | 7/1967 | Owsley et al. . | |
| 4,396,075 | 8/1983 | Wood et al. . | |
| 4,402,551 | 9/1983 | Wood et al. . | |
| 4,415,205 | 11/1983 | Rehm et al. . | |
| 4,436,165 | 3/1984 | Emery . | |
| 4,444,276 | 4/1984 | Peterson, Jr. . | |
| 4,573,541 | 3/1986 | Josse et al. . | |
| 4,807,704 | 2/1989 | Hsu et al. . | |
| 4,986,361 | 1/1991 | Mueller et al. . | |
| 5,052,488 | 10/1991 | Fraser, III | 166/291 X |
| 5,289,876 | 3/1994 | Graham . | |
| 5,301,760 | 4/1994 | Graham . | |
| 5,318,122 | 6/1994 | Murray et al. . | |
| 5,337,808 | 8/1994 | Graham . | |

FOREIGN PATENT DOCUMENTS

| | | |
|---|---|---|
| 41068/93 | 12/1993 | Australia . |
| 2221482 | 2/1990 | United Kingdom . |
| 2240563 | 8/1991 | United Kingdom . |
| WO94/03699 | 2/1994 | WIPO . |

*Primary Examiner*—Michael Powell Buiz
*Attorney, Agent, or Firm*—Fishman, Dionne & Cantor

[57] ABSTRACT

The present invention relates to two improved methods for multilateral completion and cementing (e.g. sealing) the juncture between primary and lateral wellbores. These two completion methods of the present invention address the issue of cementation of the lateral wellbores for the purpose of zonal isolation. It is desirable to have the ability to re-enter each lateral wellbore as well as maintain the option to perform any function that could be done in a single wellbore. For this reason, cemented lateral wellbores are desirable so that normal isolation, stimulation or any other operation can be achieved. The methods allow sealing and reworking of either wellbores with single laterals or multiple laterals and provide safe durable junctions therebetween.

18 Claims, 23 Drawing Sheets

METHOD FOR MULTI-LATERAL COMPLETION AND CEMENTING THE JUNCTURE WITH LATERAL WELLBORES

BACKGROUND OF THE INVENTION

This invention relates generally to the completion of wellbores. More particularly, this invention relates to new and improved methods and devices for completion of a branch wellbore extending laterally from a primary well which may be vertical, substantially vertical, inclined or even horizontal. This invention finds particular utility in the completion of multilateral wells, that is, downhole well environments where a plurality of discrete, spaced lateral wells extend from a common vertical wellbore.

Horizontal well drilling and production have been increasingly important to the oil industry in recent years. While horizontal wells have been known for many years, only relatively recently have such wells been determined to be a cost effective alternative (or at least companion) to conventional vertical well drilling. Although drilling a horizontal well costs substantially more than its vertical counterpart, a horizontal well frequently improves production by a factor of five, ten, or even twenty in naturally fractured reservoirs. Generally, projected productivity from a horizontal well must triple that of a vertical hole for horizontal drilling to be economical. This increased production minimizes the number of platforms, cutting investment and operational costs. Horizontal drilling makes reservoirs in urban areas, permafrost zones and deep offshore waters more accessible. Other applications for horizontal wells include periphery wells, thin reservoirs that would require too many vertical wells, and reservoirs with coning problems in which a horizontal well could be optimally distanced from the fluid contact.

Some horizontal wells contain additional wells extending laterally from the primary vertical wells. These additional lateral wells are sometimes referred to as drainholes and vertical wells containing more than one lateral well are referred to as multilateral wells. Multilateral wells are becoming increasingly important, both from the standpoint of new drilling operations and from the increasingly important standpoint of reworking existing wellbores including remedial and stimulation work.

As a result of the foregoing increased dependence on and importance of horizontal wells, horizontal well completion, and particularly multilateral well completion have been important concerns and have provided (and continue to provide) a host of difficult problems to overcome. Lateral completion, particularly at the juncture between the vertical and lateral wellbore is extremely important in order to avoid collapse of the well in unconsolidated or weakly consolidated formations. Thus, open hole completions are limited to competent rock formations; and even then open hole completion is inadequate since there is no control or ability to re-access (or re-enter the lateral) or to isolate production zones within the well. Coupled with this need to complete lateral wells is the growing desire to maintain the size of the wellbore in the lateral well as close as possible to the size of the primary vertical wellbore for ease of drilling and completion.

Conventionally, horizontal wells have been completed using either slotted liner completion, external casing packers (ECP's) or cementing techniques. The primary purpose of inserting a slotted liner in a horizontal well is to guard against hole collapse. Additionally, a liner provides a convenience path to insert various tools such as coiled tubing in a horizontal well. Three types of liners have been used namely (1) perforated liners, where holes are drilled in the liner, (2) slotted liners, where slots of various width and depth are milled along the liner length, and (3) prepacked liners.

Slotted liners provide limited sand control through selection of hole sizes and slot width sizes. However, these liners are susceptible to plugging. In unconsolidated formations, wire wrapped slotted liners have been used to control sand production. Gravel packing may also be used for sand control in a horizontal well. The main disadvantage of a slotted liner is that effective well stimulation can be difficult because of the open annular space between the liner and the well. Similarly, selective production (e.g., zone isolation) is difficult.

Another option is a liner with partial isolations. External casing packers (ECPs) have been installed outside the slotted liner to divide a long horizontal well bore into several small sections. This method provides limited zone isolation, which can be used for stimulation or production control along the well length. However, ECP's are also associated with certain drawbacks and deficiencies. For example, normal horizontal wells are not truly horizontal over their entire length, rather they have many bends and curves. In a hole with several bends it may be difficult to insert a liner with several external casing packers.

Finally, it is possible to cement and perforate medium and long radius wells are shown, for example, in U.S. Pat. No. 4,436,165.

While sealing the juncture between a vertical and lateral well is of importance in both horizontal and multilateral wells, re-entry and zone isolation is of particular importance and pose particularly difficult problems in multilateral well completions. Re-entering lateral wells is necessary to perform completion work, additional drilling and/or remedial and stimulation work. Isolating a lateral well from other lateral branches is necessary to prevent migration of fluids and to comply with completion practices and regulations regarding the separate production of different production zones. Zonal isolation may also be needed if the borehole drifts in and out of the target reservoir because of insufficient geological knowledge or poor directional control; and because of pressure differentials in vertically displaced strata as will be discussed below.

When horizontal boreholes are drilled in naturally fractured reservoirs, zonal isolation is seen as desirable. Initial pressure in naturally fractured formations may vary from one fracture to the next, as may the hydrocarbon gravity and likelihood of coning. Allowing them to produce together permits crossflow between fractures and a single fracture with early water breakthrough jeopardizes the entire well's production.

As mentioned above, initially horizontal wells were completed with uncemented slotted liners unless the formation was strong enough for an open hole completion. Both methods make it difficult to determine producing zones and, if problems develop, practically impossible to selectively treat the right zone. Today, zone isolation is achieved using either external casing packers on slotted or perforated liners or by conventional cementing and perforating.

The problem of lateral wellbore (and particularly multilateral wellbore) completion has been recognized for many years as reflected in the patent literature. For example, U.S. Pat. No. 4,807,704 discloses a system for completing multiple lateral wellbores using a dual packer and a deflective guide member. U.S. Pat. No. 2,797,893 discloses a method for completing lateral wells using a flexible liner and deflecting tool. U. S. Pat. No. 2,397,070 similarly describes lateral wellbore completion using flexible casing together with a closure shield for closing off the lateral. In U. S. Pat. No. 2,858,107, a removable whipstock assembly provides a means for locating (e.g., re-entry) a lateral subsequent to completion thereof. U.S. Pat. No. 3,330,349 discloses a mandrel for guiding and completing multiple horizontal wells. U.S. Pat. Nos. 4,396,075; 4,415,205; 4,444,276 and 4,573,541 all relate generally to methods and devices for multilateral completion using a template or tube guide head. Other patents of general interest in the field of horizontal well completion include U.S. Pat. Nos. 2,452,920 and 4,402,551.

Notwithstanding the above-described attempts at obtaining cost effective and workable lateral well completions, there continues to be a need for new and improved methods and devices for providing such completions, particularly sealing between the juncture of vertical and lateral wells, the ability to re-enter lateral wells (particularly in multilateral systems) and achieving zone isolation between respective lateral wells in a multilateral well system.

SUMMARY OF THE INVENTION

The above-discussed and other drawbacks and deficiencies of the prior art are overcome or alleviated by the several methods and devices of the present invention for completion of lateral wells and more particularly the completion of multilateral wells. In accordance with prior application Ser. No. 07/926,451 filed Aug. 7, 1992, assigned to the assignee hereof, all of the contents of which are incorporated herein by reference, a plurality of methods and devices were provided for solving important and serious problems posed by lateral (and especially multilateral) completion including:

1. Methods and devices for sealing the junction between a vertical and lateral well.
2. Methods and devices for re-entering selected lateral wells to perform completion work, additional drilling, or remedial and stimulation work.
3. Methods and devices for isolating a lateral well from other lateral branches in a multilateral well so as to prevent migration of fluids and to comply with good completion practices and regulations regarding the separate production of different production zones.

In accordance with the present invention, two improved methods relating to multilateral completion and cementing (e.g. sealing) the juncture with lateral wellbores are presented. These two completion methods of the present invention address the issue of cementation of the lateral wellbores for the purpose of zonal isolation. It is desirable to have the ability to re-enter each lateral wellbore as well as maintain the option to perform any function that could be done in a single wellbore. For this reason, cemented lateral wellbores are desirable so that normal isolation, stimulation or any other operation can be achieved.

In the first preferred embodiment, a first lateral wellbore is cemented with a liner. A retrievable orientation anchor is placed in the primary wellbore at the place in the primary wellbore where it is desired to drill a second lateral wellbore. A second lateral wellbore is then drilled in a known manner. A landing collar, liner, plug holder bushing with plug, a cementing sleeve, a liner setting tool and a polished bore receptacle with scoop head are run into the second lateral wellbore. A scab liner is then run in from the primary wellbore to and into the second lateral wellbore. The second lateral wellbore is cemented and then perforated in a known manner. ISO packers and sliding sleeves (or other completion devices) are then deposited in the second lateral wellbore and thus the second lateral wellbore is completed. The scab liner and whipstock are subsequently removed from the primary vertical wellbore. The first lateral wellbore is now completed in a known manner similar to the completion procedure summarized for the second lateral wellbore. The final step in this first preferred embodiment is to install a parallel scoop head, a diverter sub, appropriate connecting tubes and a selective re-entry tool protected by a retrievable safety valve, all of which is connected to the workstring. Thus, either the first lateral wellbore or the second lateral wellbore can be isolated or operated on as required.

In the second preferred embodiment, a first lateral wellbore is cemented in a known manner out of the bottom of a primary wellbore. This first lateral wellbore is then completed in a known manner. With the help of a retrievable whipstock and whipstock orientation anchor, a second lateral is drilled. The retrievable whipstock is then withdrawn from the primary wellbore. A parallel scoop head, a diverter sub and appropriate connecting tubes are next run into the primary wellbore and connected up to the first completed lateral wellbore. The second lateral wellbore and junction between the second lateral wellbore and primary wellbore are cemented and sealed in a known manner, however, it is an important aspect of the invention to ensure that the cement is poured to a level above the origin of the lateral wellbore. The second lateral wellbore is then completed in a known manner. The final step in this second preferred embodiment is to install a selective re-entry tool which allows either the first or second lateral wellbore to be isolated or worked as desired.

The above-discussed and other features and advantages of the present invention will be appreciated to those skilled in the art from the following detailed description and drawings.

BRIEF DESCRIPTION OF THE DRAWINGS

Referring now to the drawings, wherein like elements are numbered alike in the several FIGURES:

FIG. 1A is a cross-sectional elevation view depicting the cementing of a first lateral wellbore prior to the boring of a second lateral wellbore;

FIGS. 1I & 1J show a cross-sectional elevation view depicting a retrieval operation to clear the primary wellbore;

FIG. 1N is a cross-sectional elevation view depicting completion of the installation of selective re-entry tools for both lateral wellbores.

FIG. 2A–2J are sequential cross-sectional elevation views depicting a second preferred method for sealing a juncture between a vertical primary wellbore and lateral wellbores using cementation, perforation and permanent access equipment;

FIG. 2A is a cross-sectional elevation view depicting the cementing of a vertical wellbore;

FIG. 2B is a cross-sectional elevation view depicting liner cementation for a first lateral wellbore;

FIG. 2C is a cross-sectional elevation view depicting conventional ISO packer completion;

FIG. 2D is a cross-sectional elevation view depicting retrieval of the running tool;

FIG. 2E is a cross-sectional elevation view depicting the drilling of an upper (or second) lateral wellbore;

FIG. 2F is a cross-sectional elevation view depicting retrieval of the whipstock;

FIG. 2G is a cross-sectional elevation view depicting the installation of a diverter sub and parallel scoop head;

FIG. 2H is a cross-sectional elevation view depicting cementation of the upper (or second) lateral wellbore junction;

FIG. 2I is a cross-sectional elevation view depicting upper lateral (or second) wellbore completion;

FIG. 2J is a cross-sectional elevation view depicting the completion of the selective re-entry tool installation.

DESCRIPTION OF THE PREFERRED EMBODIMENT

In accordance with the present invention, two embodiments of methods and devices for completing lateral, branch or horizontal wells which extend from a single primary wellbore, and more particularly for completing multiple wells extending from a single generally vertical wellbore (multilaterals) are described. It will be appreciated that although the terms primary, vertical, deviated, horizontal, branch and lateral are used herein for convenience, those skilled in the art will recognize that the devices and methods of the present invention may be employed with respect to wells which extend in directions other than generally vertical or horizontal. For example, the primary wellbore may be vertical, inclined or even horizontal. Therefore, in general, the substantially vertical well will sometimes be referred to as the primary well and the wellbores which extend laterally or generally laterally from the primary wellbore may be referred to as the branch wellbores.

This invention discloses two preferred methods of cementing lateral wellbores extending from a parent or primary wellbore. This invention defines two methods for the correct placement of the cement in lateral wellbores as well as the ability to control the cement as in a normal liner cementation job.

Figure 1A:
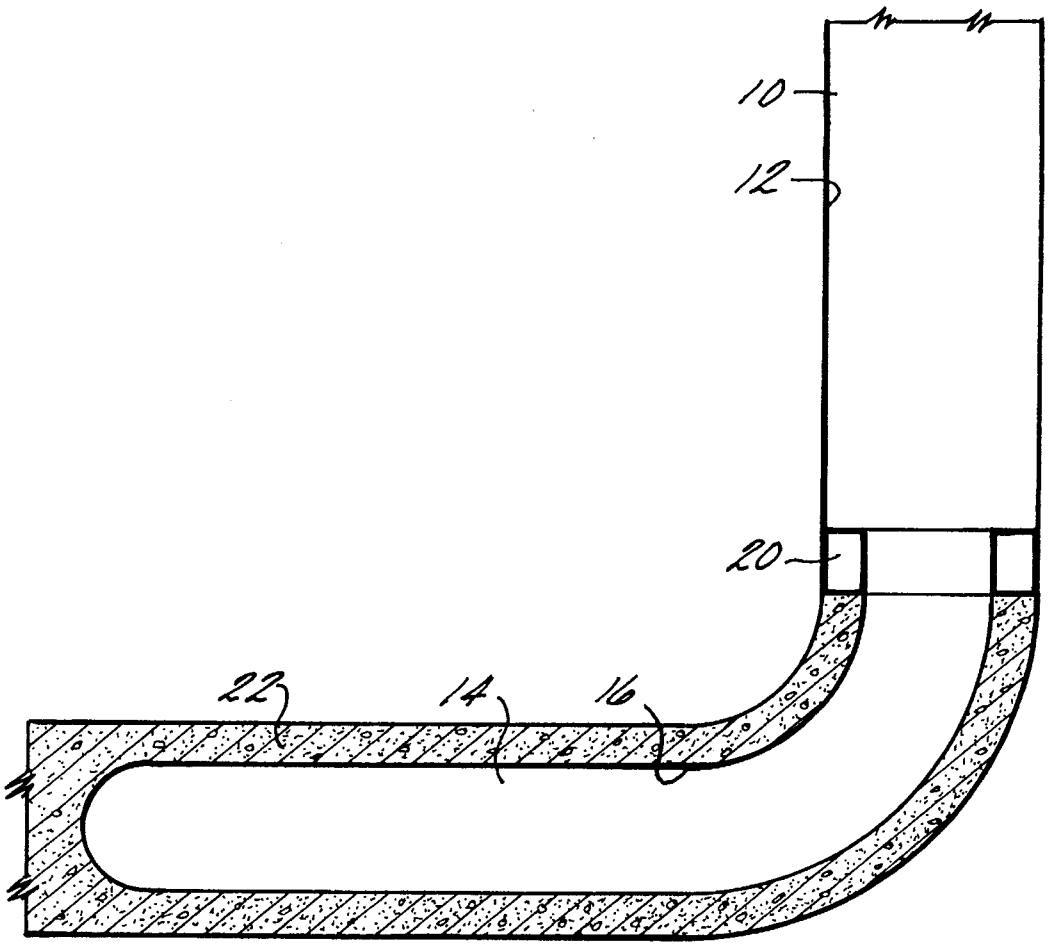
FIGS. 1A–1N are sequential cross-sectional elevation views depicting a first preferred method for sealing a juncture between a vertical primary wellbore and lateral wellbores using cementation, perforation and permanent access equipment.
Figure 1B:
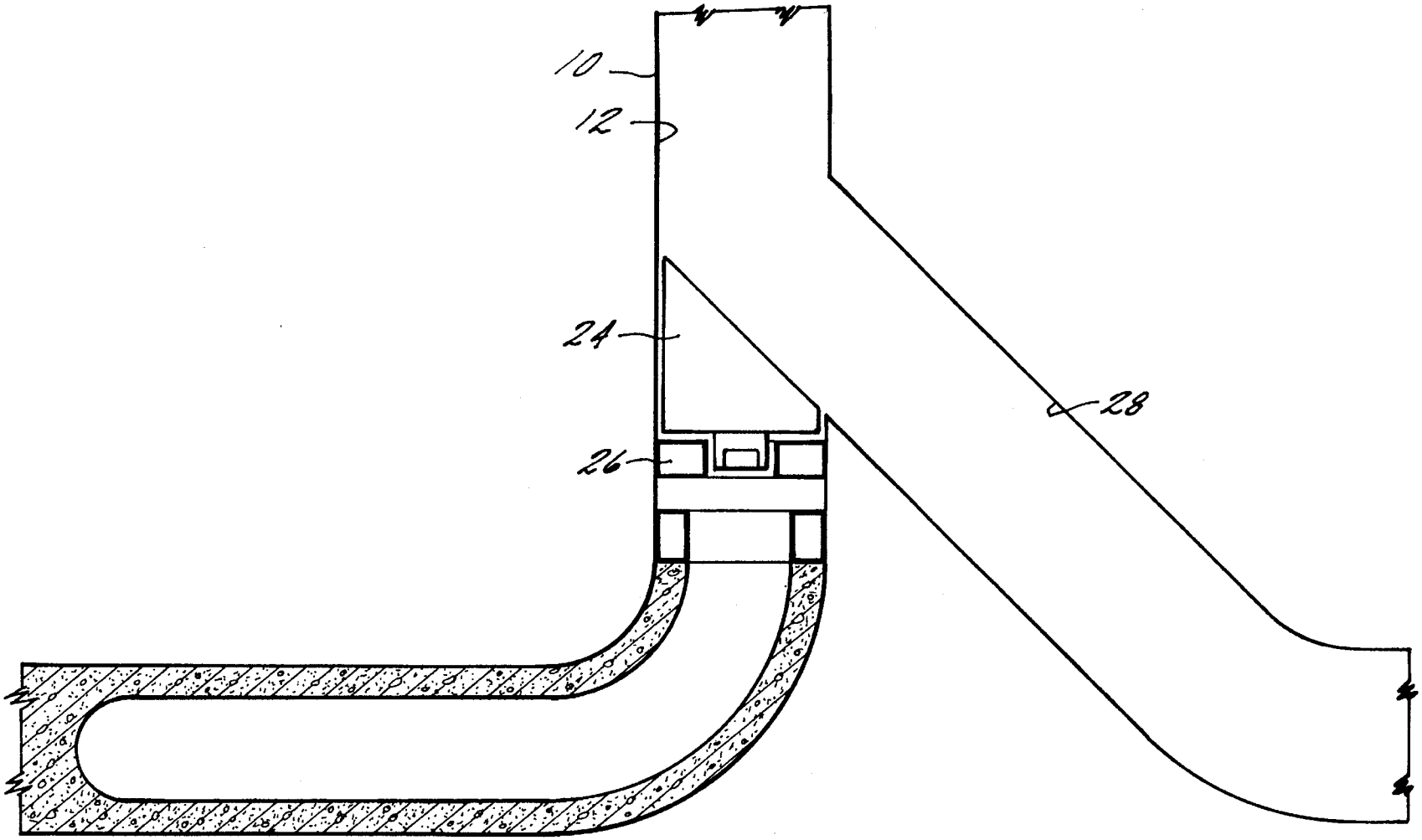
FIG. 1B is a cross-sectional elevation view depicting the setting of a retrievable whipstock and the drilling of a second lateral wellbore.
Figure 1C:
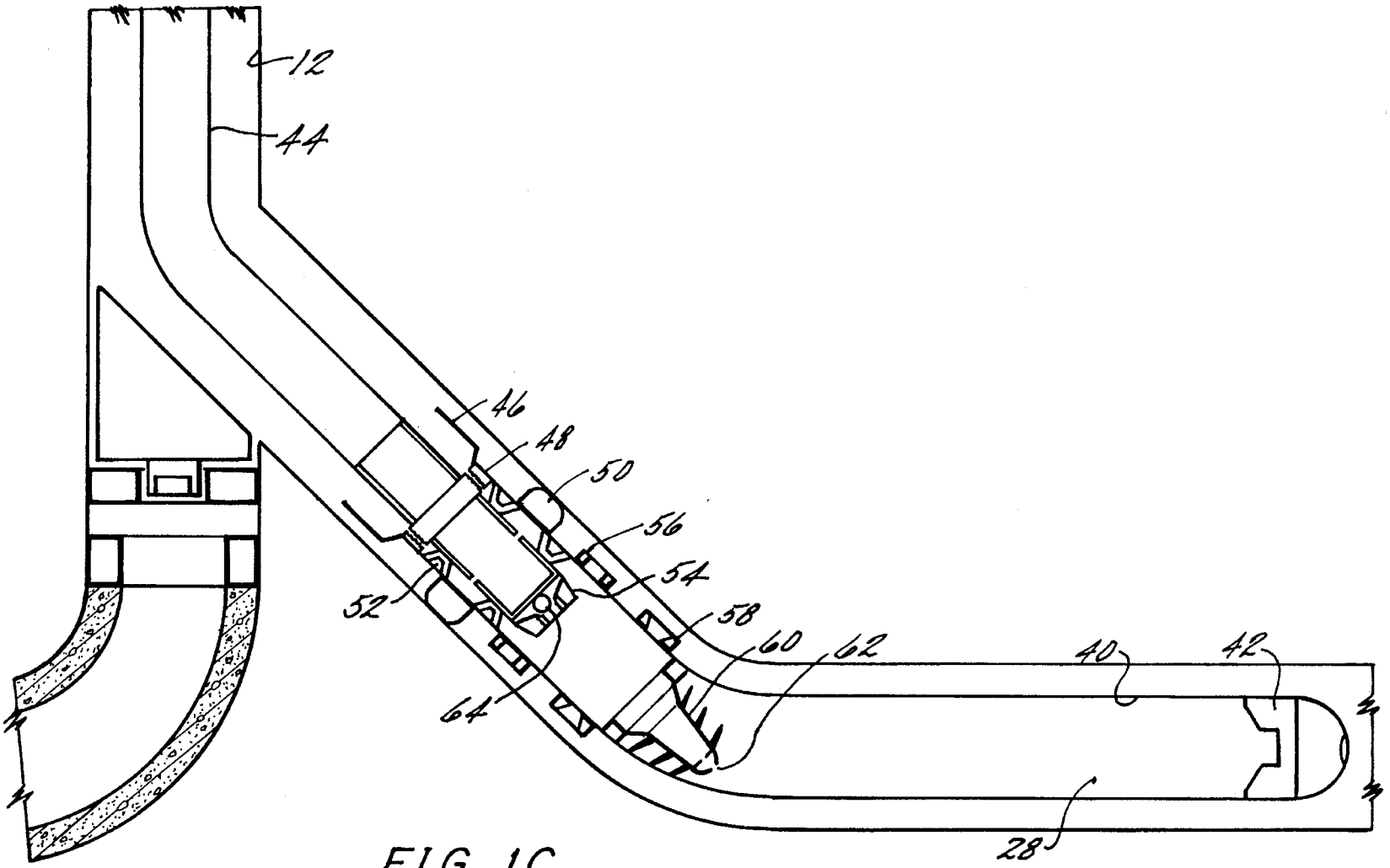
FIG. 1C is a cross-sectional elevation view depicting a liner running tool complete with ball seat sub operation.
Figure 1D:
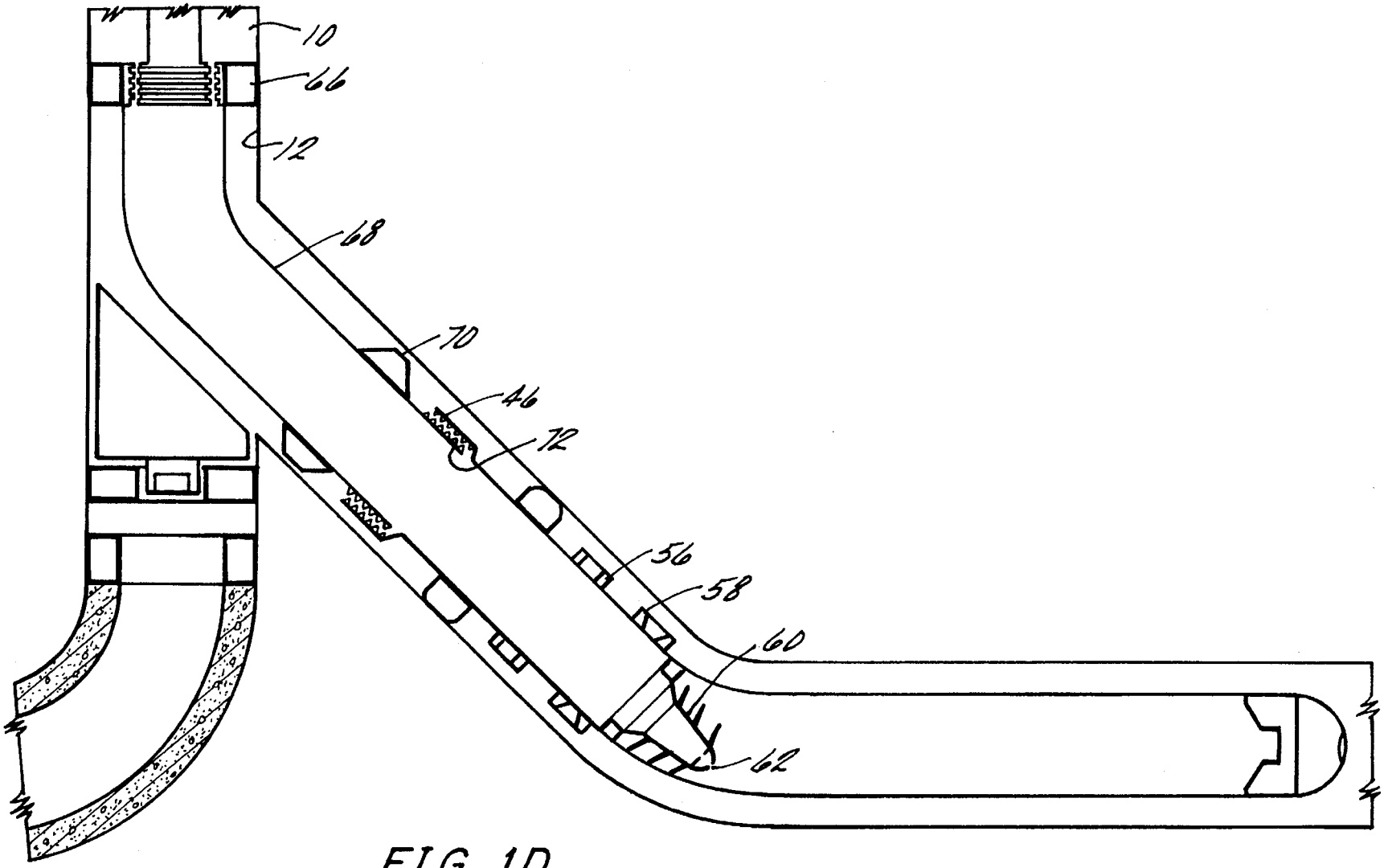
FIG. 1D is a cross-sectional elevation view depicting a scab liner installation operation.
Figure 1E:
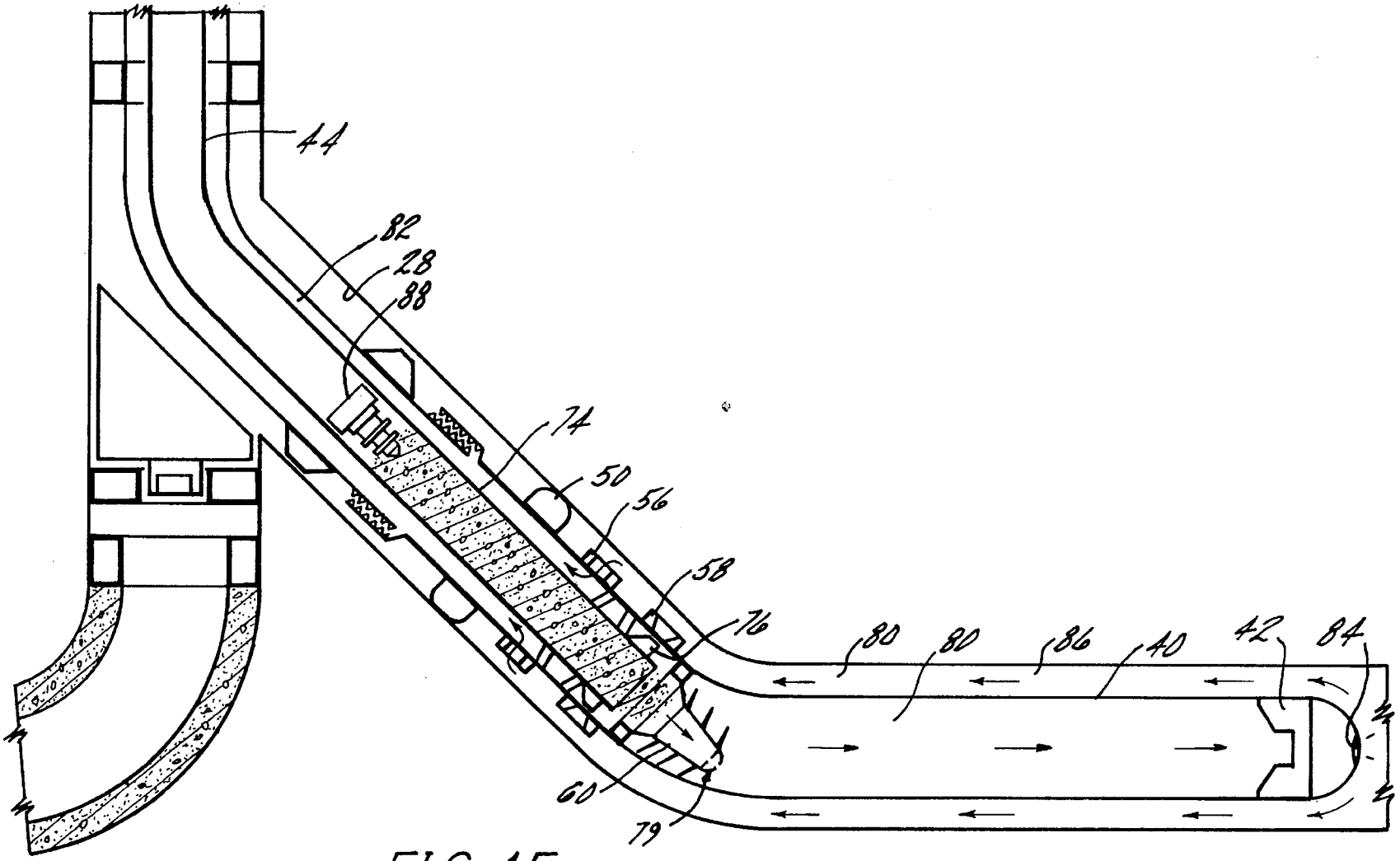
FIG. 1E is a cross-sectional elevation view depicting a second lateral wellbore cementing operation.
Figure 1F:
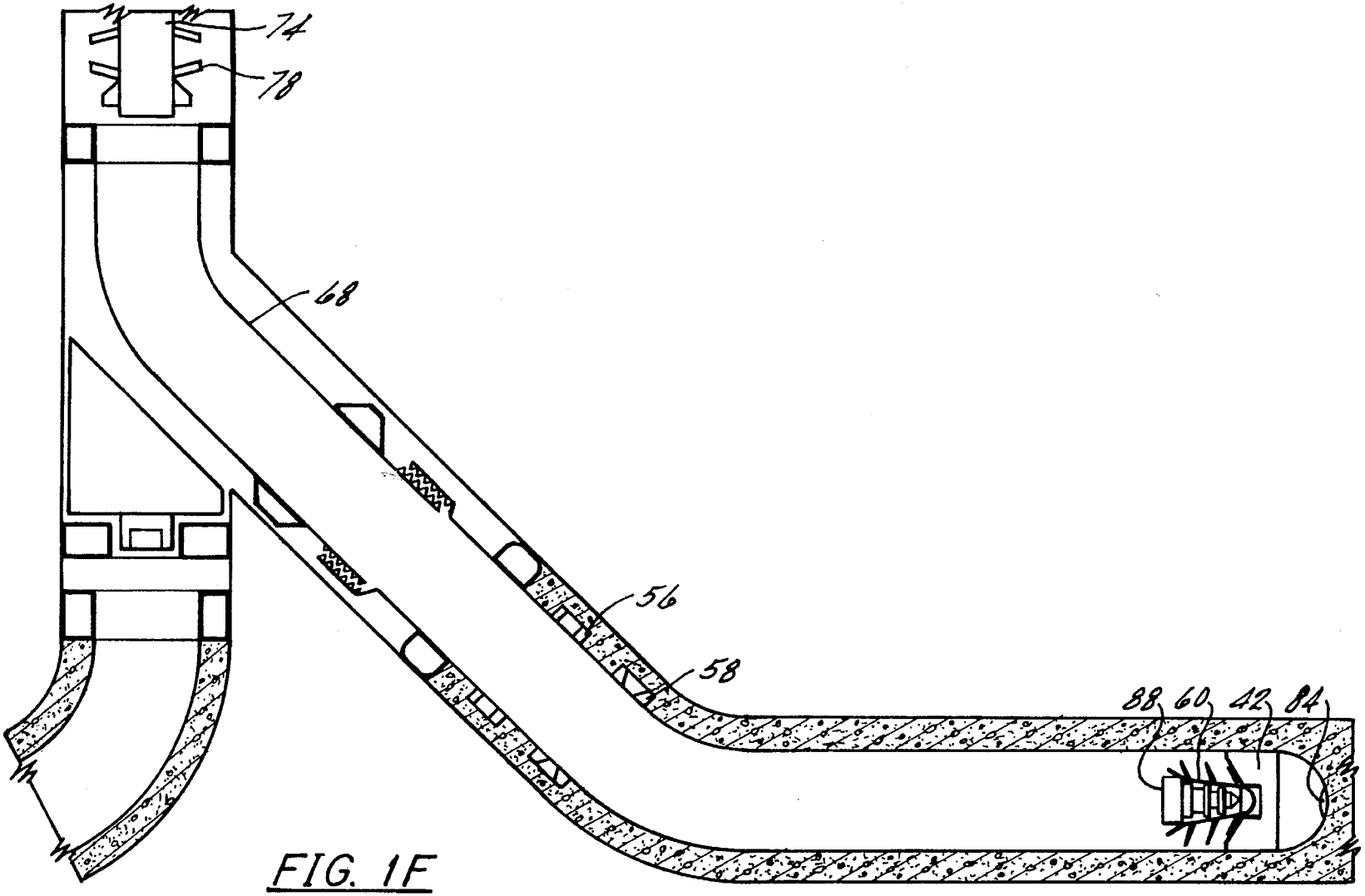
FIG. 1F is a cross-sectional elevation view depicting removal of the workstring and cleaning of excess cement from a second lateral wellbore.
Figure 1G:
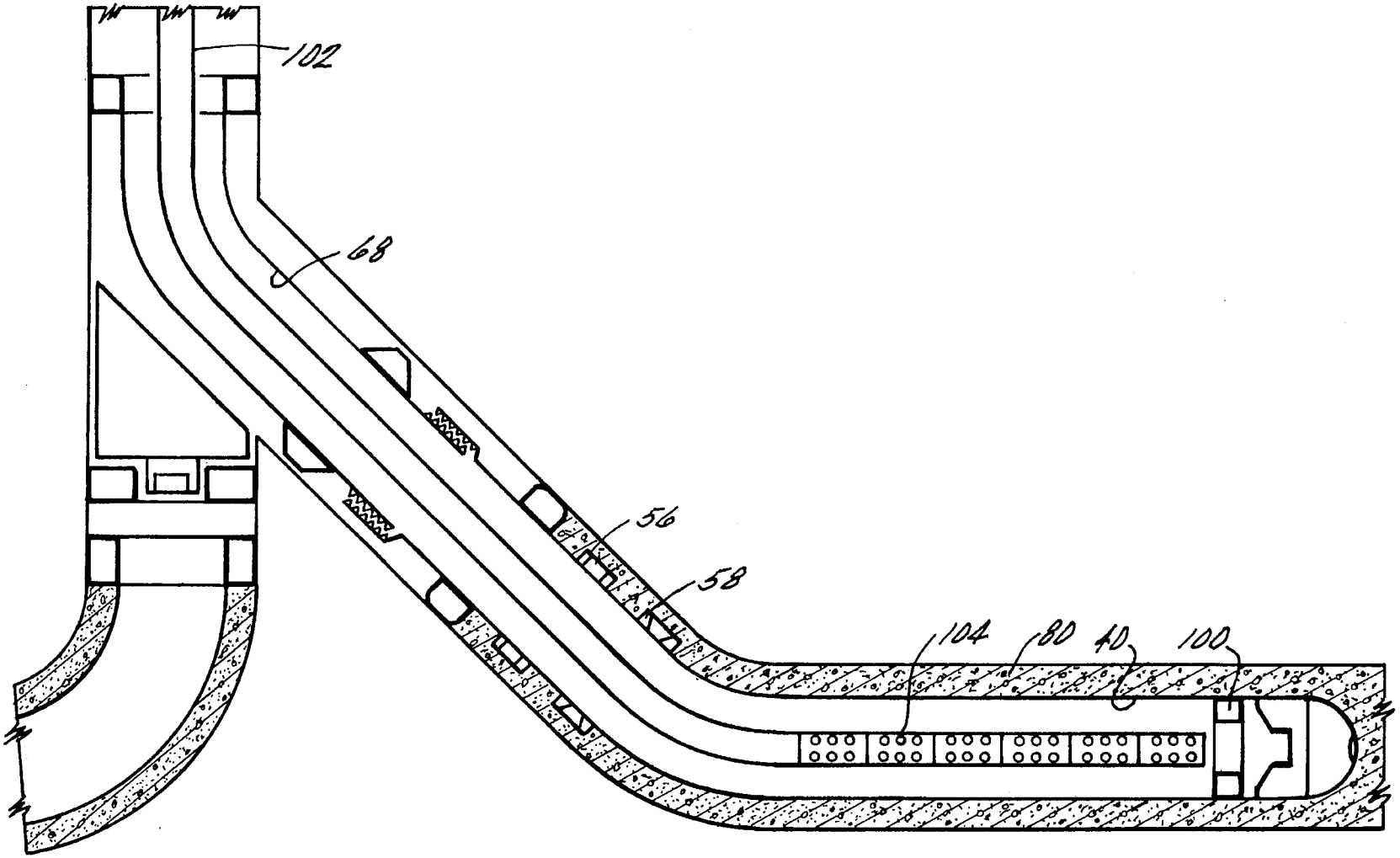
FIG. 1G is a cross-sectional elevation view depicting a TCP gun perforation operation of the second lateral wellbore.
Figure 1H:
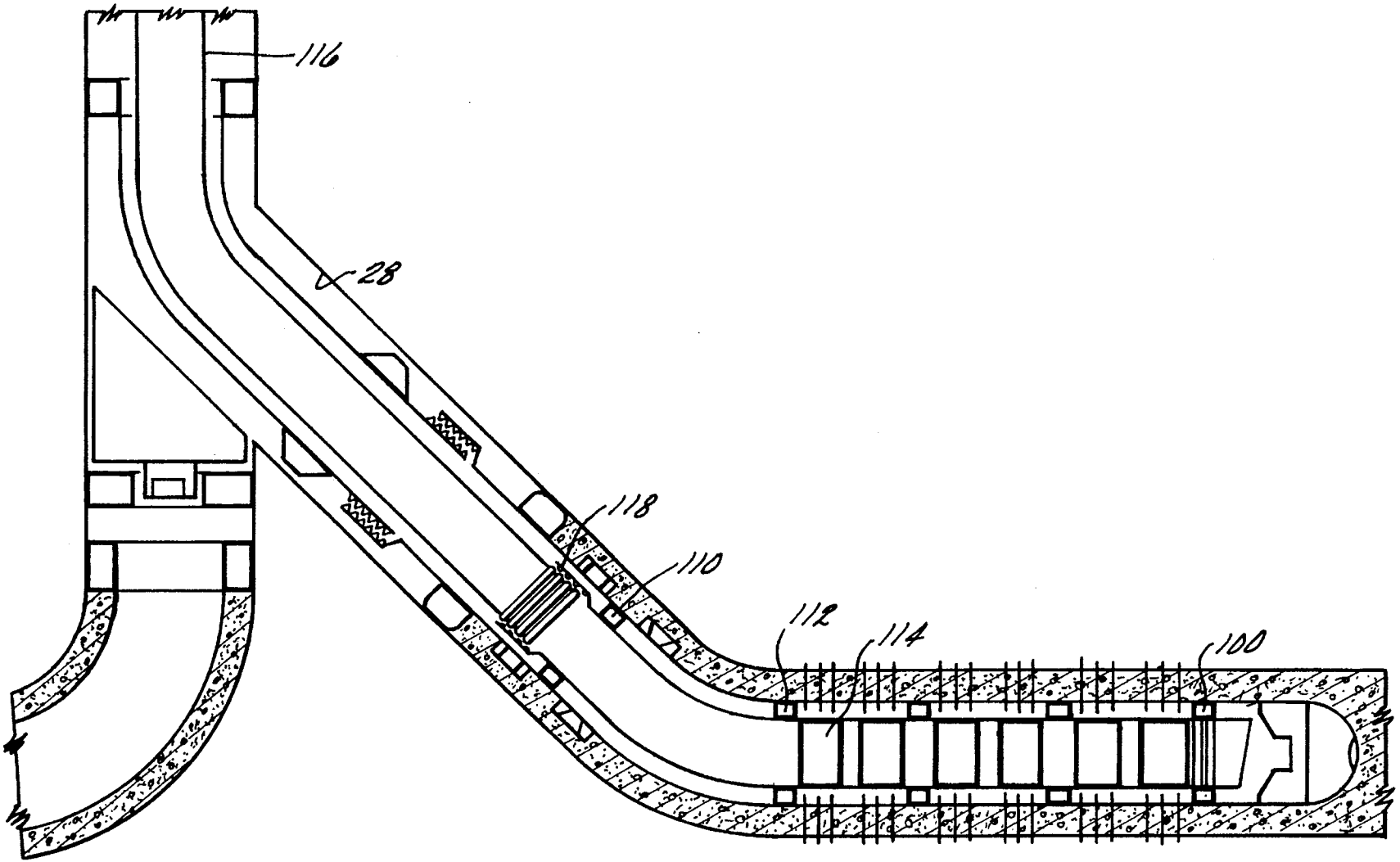
FIG. 1H is a cross-sectional elevation view depicting installation of sliding sleeves in the second lateral wellbore.
Figure 11:
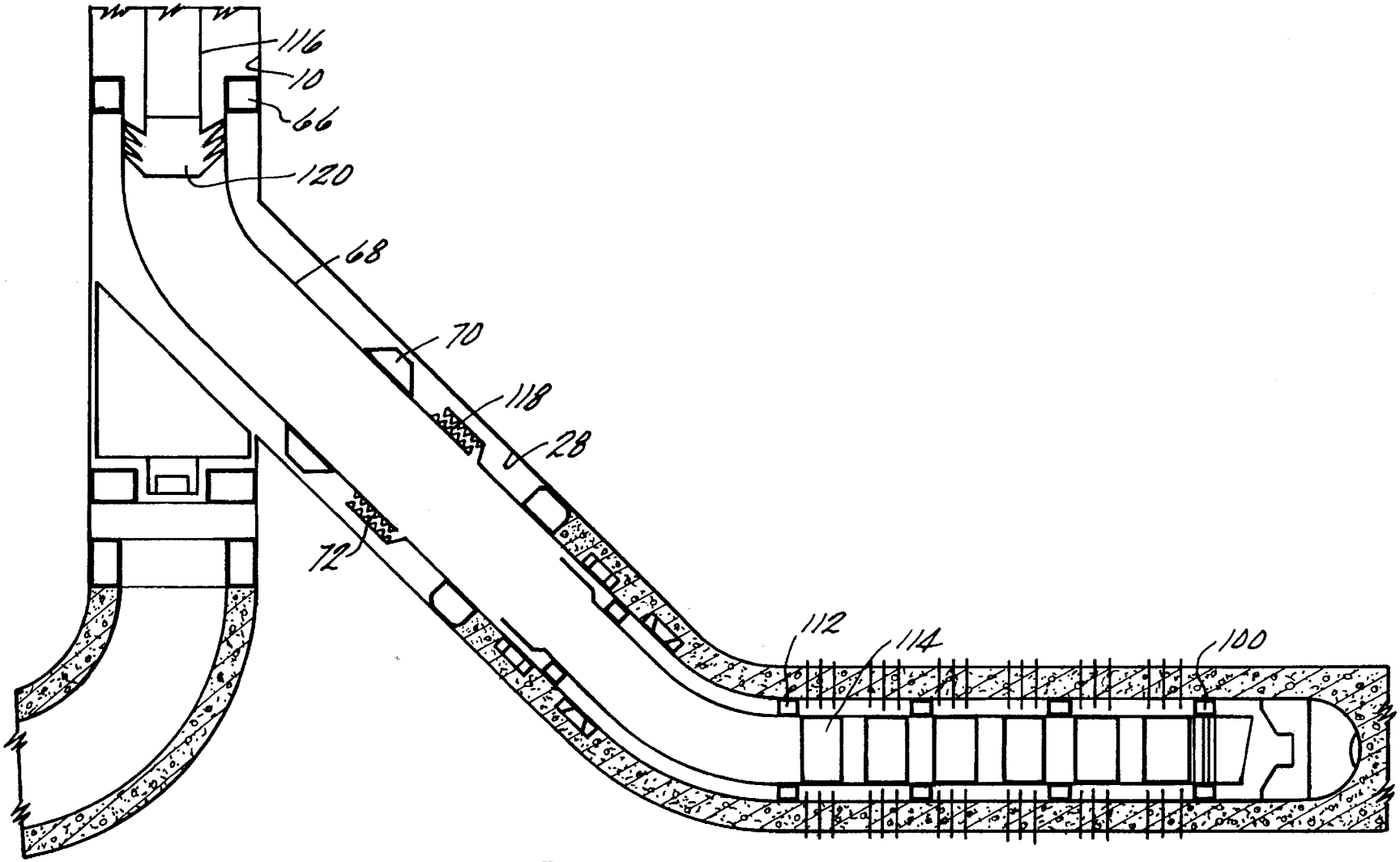
Figure 1J:
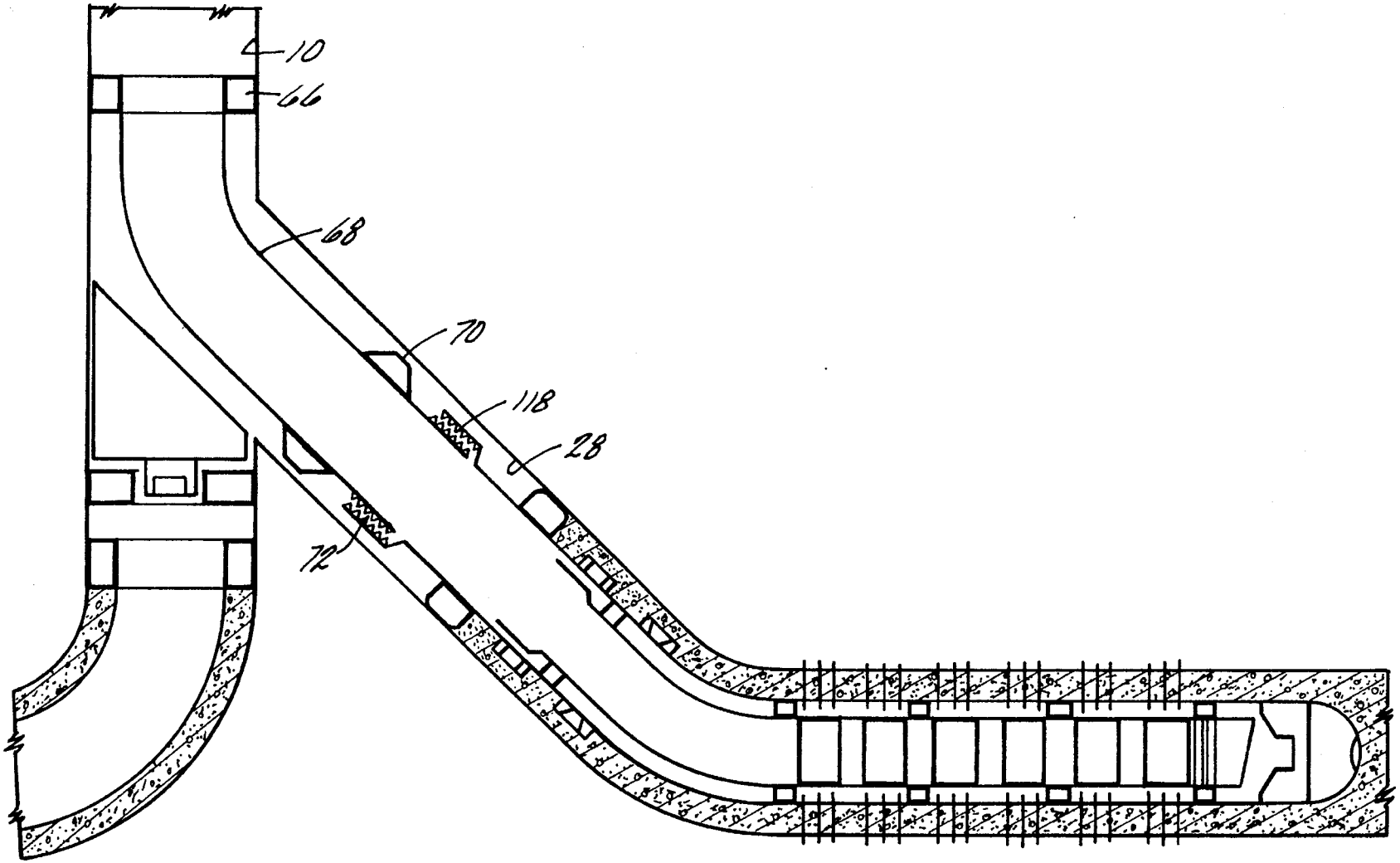
Figure 1K:
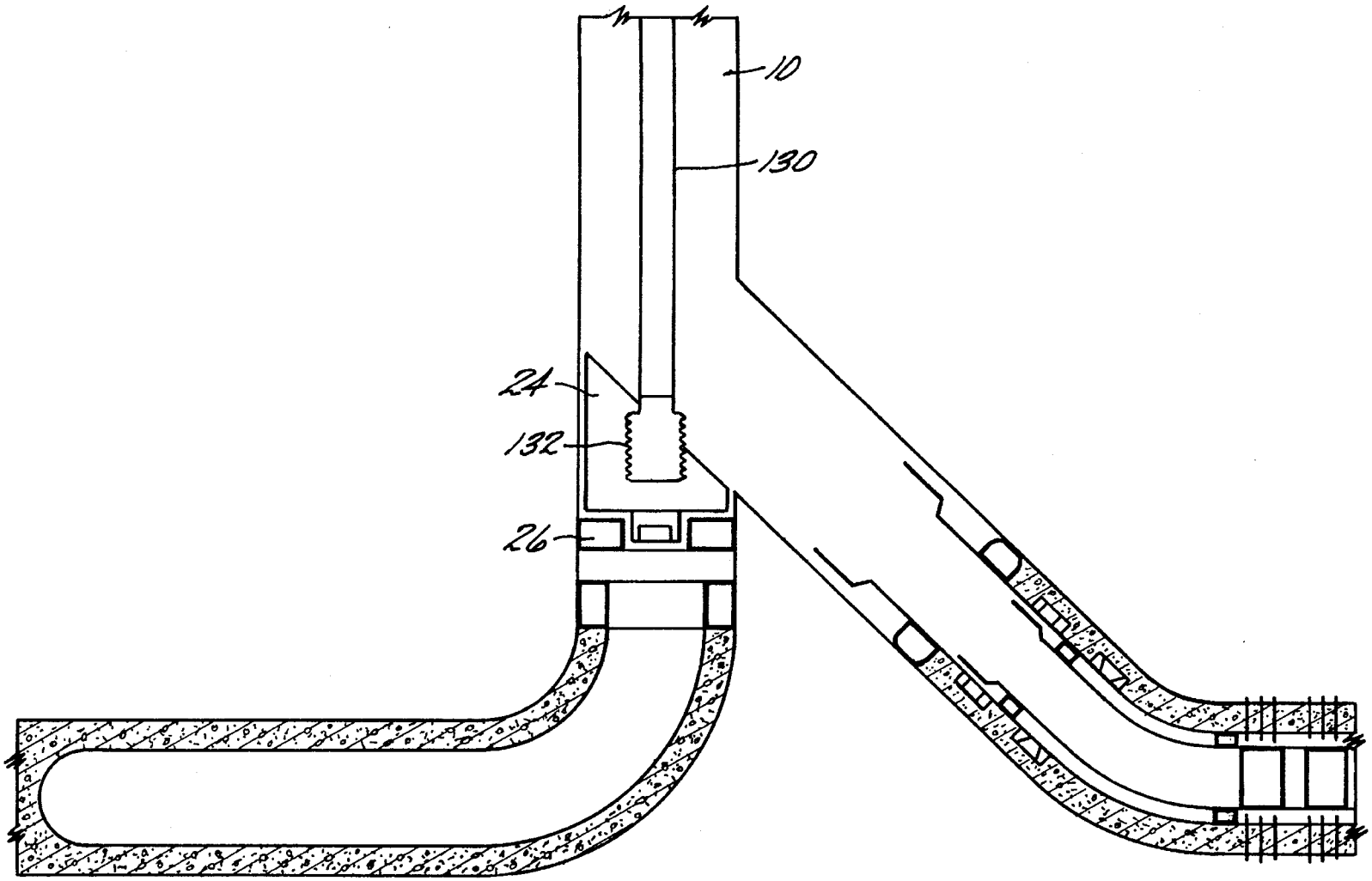
FIG. 1K is a cross-sectional elevation view depicting the whipstock retrieval.
Figure 1L:
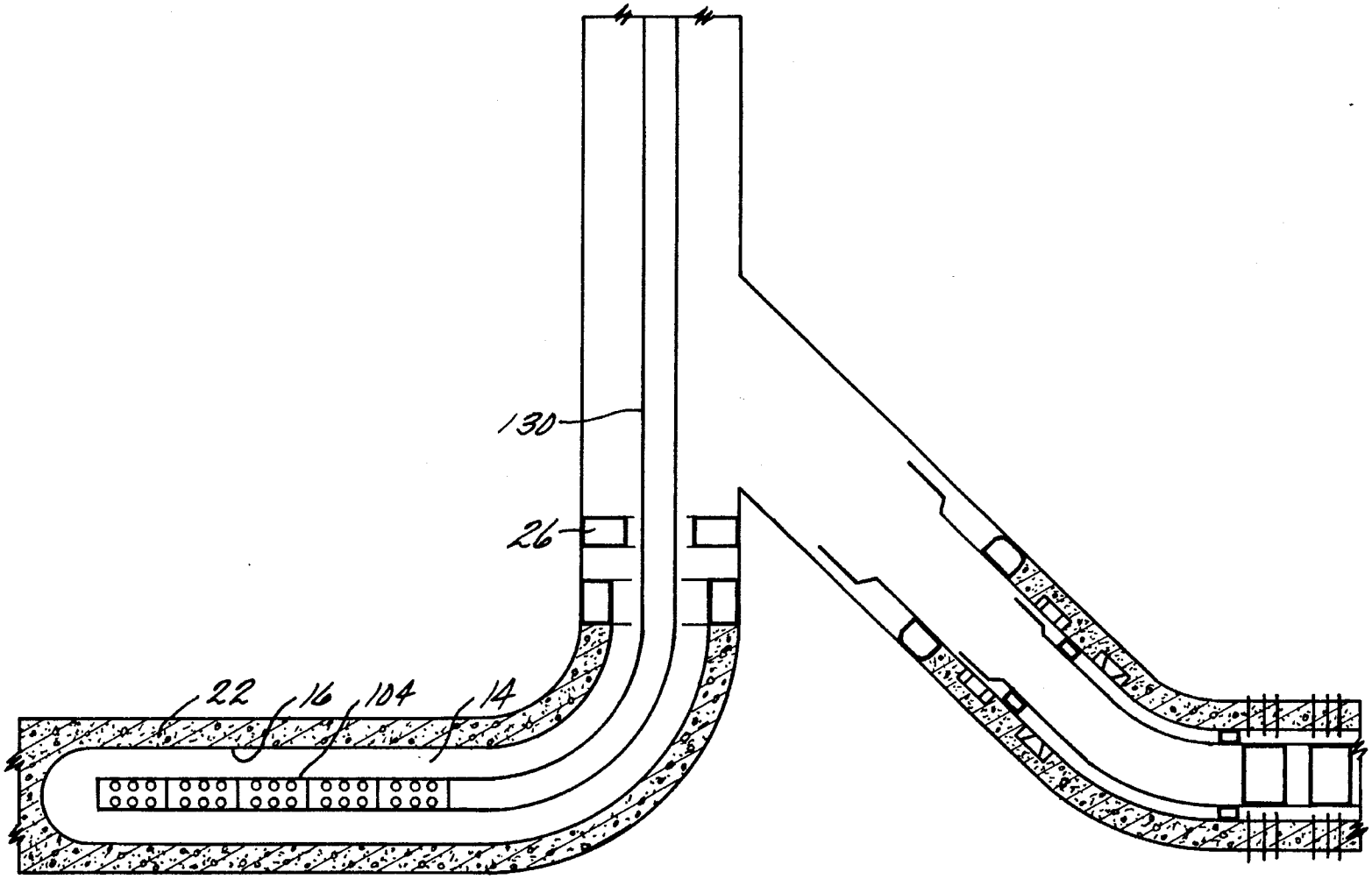
FIG. 1L is a cross-sectional elevation view depicting a TCP gun perforation operation of the first lateral wellbore.
Figure 1M:
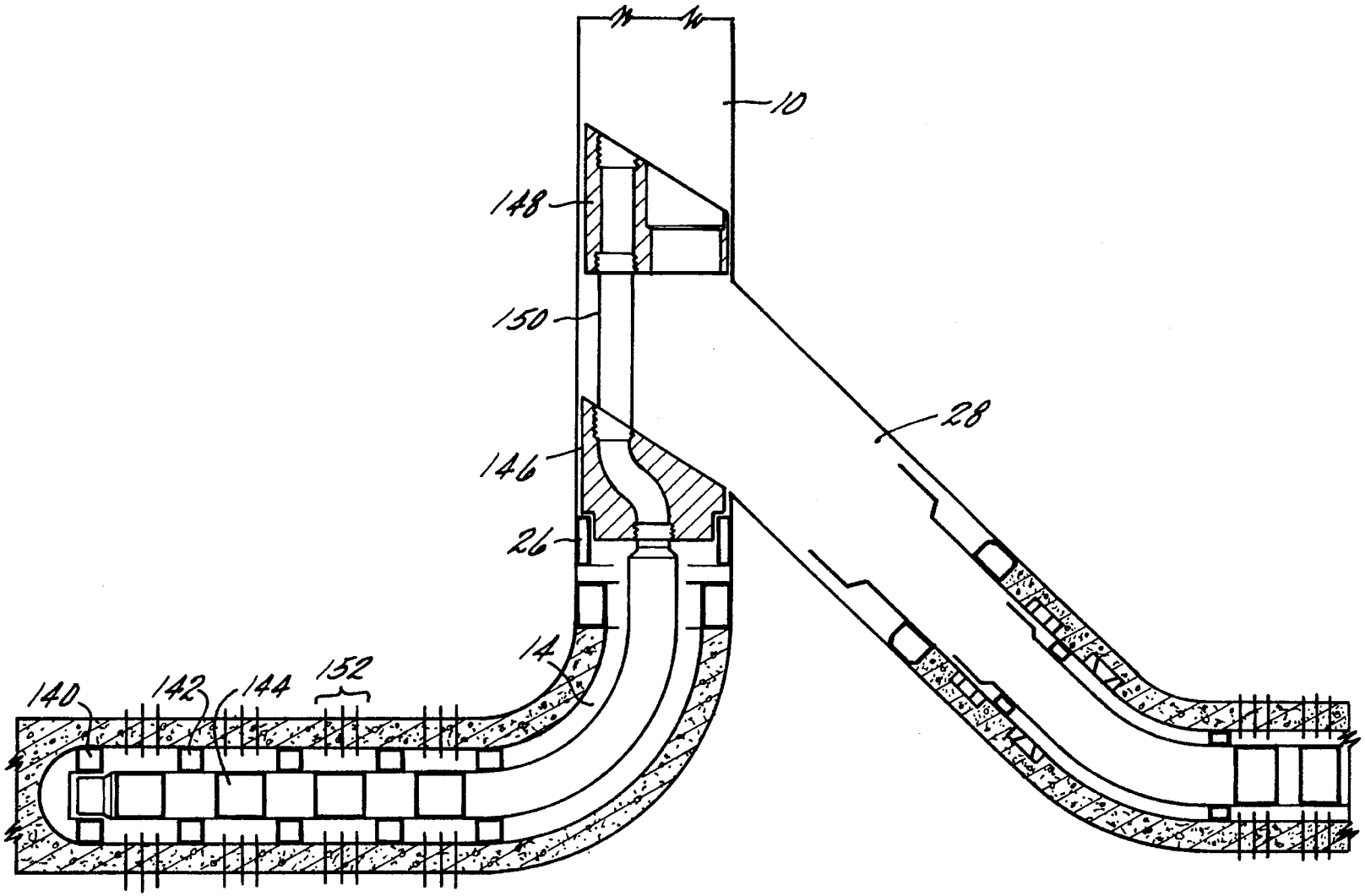
FIG. 1M is a cross-sectional elevation view depicting installation of a lateral wellbore diverter and installation of sliding sleeves in the first lateral wellbore.
Figure 1N:
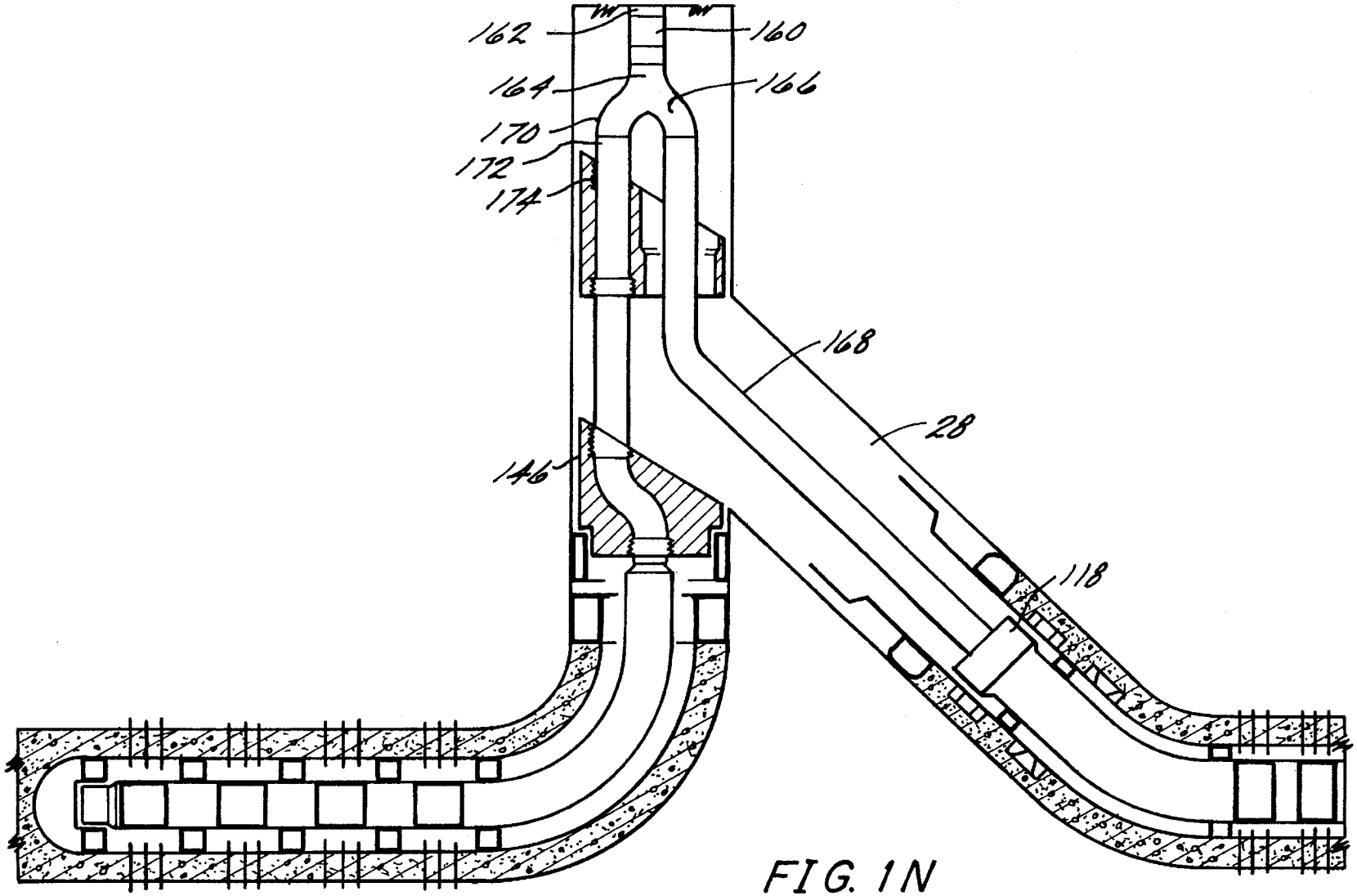

Referring now to FIGS. 1A–1N, a method and apparatus is presented for multi-lateral completion and cementing the juncture with lateral wellbores in accordance with the first embodiment of this invention. In accordance with this method, a primary or vertical wellbore 10 (see FIG. 1A) is initially drilled. Next, in a conventional manner, a well casing 12 is set and/or cemented in place in a conventional manner. Thereafter, lower lateral well 14 (lateral wellbore #1) is drilled and is completed in a known manner using a liner 16 which attaches to casing 12 by a suitable packer or liner hanger 20. Liner 16 is cemented in place with cement 22 in a conventional and known manner.

Referring now to FIG. 1B, a retrievable whipstock orientation anchor 24 (Baker Oil Tools Model 'ML'783–59) and whipstock packer 26 (Baker Oil Tools Model 'ML') are set at the desired point in primary well 10. It will be appreciated that any other suitable retrievable whipstock assembly may be used such as disclosed in commonly assigned U.S. application Ser. No. 08/186,267 filed Jan. 25, 1994, all of the contents of which are incorporated herein by reference. Next, lateral 28 is drilled through casing 12 in a known manner.

Next, referring to FIG. 1C, a liner 40 is run down casing 12 and into lateral wellbore 28. Liner 40 terminates at a landing collar 42. The next step is to run in a workstring 44 which contains at the working end of the workstring 44, the following equipment. A polished bore receptacle with scoop head 46 combined with a liner setting tool 48 (preferably Baker Oil Tools Model "2RH") which is surrounded by an external casing packer or ECP 50 along with a cup assembly 52 attached complete with a ball seat sub 54. Attached to the polished bore receptacle is a cementing sleeve 56 which is in the open position. Attached forward of the cementing sleeve 56 is an indicating collet 58 and at the leading portion of the entire assembly is a plug holder bushing 60 together with a plug 62. After the required setting depth is reached, a tripping ball 64 is dropped and pumped to seat in ball seat sub 54. Pressure is then applied and the ECP 50 is set. The tripping ball 64 is retained in the ball seat sub 54.

Referring now to FIG. 1D, the ball seat sub 54 is retrieved. Next, a scab liner packer 66 is set in place at the desired depth of primary wellbore 10 and scab liner packer 66 is fixed against primary casing 12. Scab liner 68 along with a stabilizer 70 and PBR seal assembly 72 is also run in with scab liner packer 66 and seated into the polished bore receptacle 46. The cementing sleeve 56 (in the open position), the indicating collet 58 and plug holder bushing 60 with plug 62 remain in the same location as in FIG. 1C.

In FIG. 1E, a known cementing assembly 74 at the end of the workstring 44 is run in and stops at the proper location when locating collet 76 attached to the cementing assembly 74 is in proper alignment with the indicating collet 58. Just behind the locating collet 76 is a cup pack off tool (used for cementing) 78. This allows any excess cement 80 to enter into the workstring annulus 82 via the open cementing sleeve 56 because ECP 50 prevents any excess cement from traveling further up lateral wellbore 28. At this time, the cementing operation is completed in a known manner with the amount of cement being pumped in allowed to be in slight excess displacement into the workstring annulus to completely fill the annulus space around the scab liner along the entire length between the landing collar 42 and the ECP50. It should be noted that there is an opening 79 in the plug holder bushing 60 that allows the cement 80 to pass through the plug holder bushing 60 to the area between the plug holder bushing 60 and the landing collar 42. In addition, there is an opening 84 in landing collar 42 that allows the cement 80 to fill in the annular space 86 around the liner 40 between the distance just forward of landing collar 42 and ECP 50. A plug 88 follows the cement 80 and plugs up the opening 79 in plug holder bushing 60 to create a plug assembly following the completion of the cementing operation.

Next, in FIG. 1F, the plug holder bushing 60 along with plug 88 which has already been seated in plug holder bushing 60 in the previous operation, are now jettisoned and forced by known methods to plug up opening 84 in landing collar 42. The cementing sleeve 56 is now in the closed position. The cement workstring cementing assembly 74 is raised to a point above the scab liner 68 and in a known manner, excess cement is removed from the liner. Cup assembly 78 helps provide a smooth inside surface to scab liner 68. The cement workstring is then removed to complete this portion of the operation.

Referring now to FIG. 1G sump packer 100 has been run in and is set on now cemented in place liner 40. Workstring 102 is now outfitted with TCP guns 104. Scab liner 68 is already in place. Liner 40 and cement 80 are perforated as required. The TCP gun depth can be correlated off of the indicating sub by the use of indicating collet 58. The workstring 102 is then pulled out of the lateral together with the TCP guns.

As seen in FIG. 1H, the next step is to run into the lateral 28 an ISO packer P.B.R. assembly 110. This ISO P.B.R. assembly 110 consists of a multiplicity of ISO packers 112, and a multiplicity of sliding sleeves 114. Included in the workstring 116, between the workstring 116 and the ISO packer P.B.R. assembly 110 is a hydraulic release running tool 118. The ISO packers 112 and the sliding sleeves 114 can be run in one trip on the rotationally locked P.B.R. assembly setting tool 110. The setting depth is correlated off of sump packer 100.

In FIG. 1I, and 1J the hydraulic release running tool 118 has been activated and workstring 116 has been withdrawn to the primary wellbore 10. Lateral #2 is now completed.

The retrievable spear 120 is mounted onto workstring 116 and run into primary wellbore 10 just below scab liner packer 66 as can be seen in FIG. 1I. A straight pull engages the scab liner packer 66 and the SLP-R body. This straight pull disengages the slips which then allows the workstring 116 to pull scab liner packer 66, scab liner 68, stabilizer 70 and PBR seal assembly 72 out of the juncture and thus clear the juncture between lateral wellbore 2 and lateral wellbore 1.

In FIG. 1K, the workstring 130 is equipped with a whipstock assembly retrieving tool 132. Retrievable whipstock assembly 24 is engaged by whipstock assembly retrieving tool 132. Retrievable whipstock assembly 24 is then pulled out of primary wellbore 10 leaving behind the whipstock packer 26.

Referring now to FIG. 1L, TCP guns 104 are attached to workstring 130 and run into lateral #1 (14). TCP guns can be located off of the whipstock packer or simply by measured depth. Similarly, as in FIG. 1G, liner 16 and cement 22 are perforated as required. The workstring 130 is pulled out of lateral #1 (14) together with the TCP guns. Note that the whipstock packer 26 left behind is equipped with a key slot (not shown).

Turning now to FIG. 1M, the following equipment is attached to the end of the workstring (not shown). At the very end is a sump packer 140 followed by a multiplicity of ISO packers 142 together with a multiplicity of sliding sleeves 144 which are attached to the bottom of a diverter sub 146. Diverter sub 146 rests and is seated on whipstock packer with key slot 26. Above diverter sub 146 and just above the entrance to lateral wellbore #2 (28) is parallel scoop head 148. Diverter sub 146 is attached to parallel scoop head 148 by guide tube 150. All of this equipment is run into the primary borehole 10 and lateral borehole #1 (14) in one trip down hole. The lateral diverter sub 146 will orientate automatically off the key slot locator assembly 26 (whipstock packer with key slot). This same locator will also correlate the depth for completion across the multiplicity of perforations 152.

The final step for completion, isolation and selective re-entry into lateral wellbore #1 (14) or lateral wellbore #2 (28) is depicted in FIG. 1N. A retrievable safety valve 160 and a retrievable production packer 163 (BH FH style) are attached to the workstring 162. Retrievable production packer 163 is primarily for surface isolation. Below the retrievable safety valve 160 is a selective re-entry tool 164. At one branch of the inverted "Y" of the selective re-entry tool 164, designated as 166, is attached a length of workstring 168. The length of workstring 168 engages into hydraulic release tool 118 and the seal is completed in a known manner. Branch 170 of selective re-entry tool 164 has an extension 172 which engages seal bore 174. This operation is completed in one run into the primary wellbore 10 and secondary wellbore #2 (28).

Another preferred method especially useful for the purpose of zonal isolations is described below. This method maintains the ability to perform any function that could be done in a single well. Of course, these same advantages are accomplished with the first preferred method depicted in FIGS. 1A–1N.

Figure 2A:
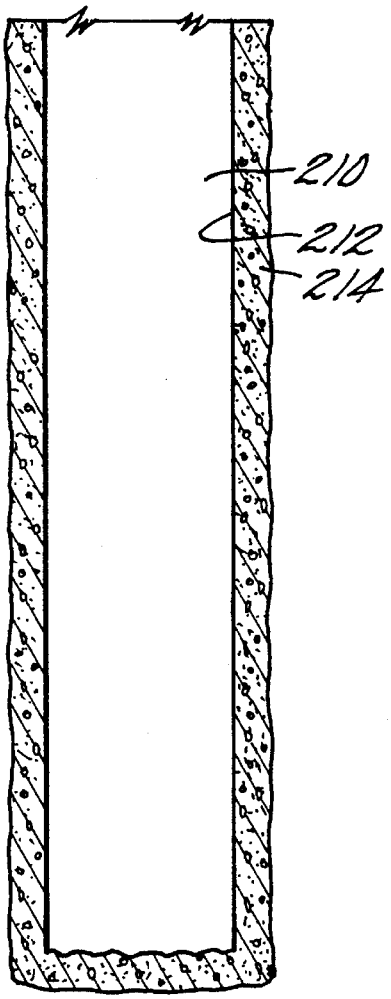
Figure 2B:
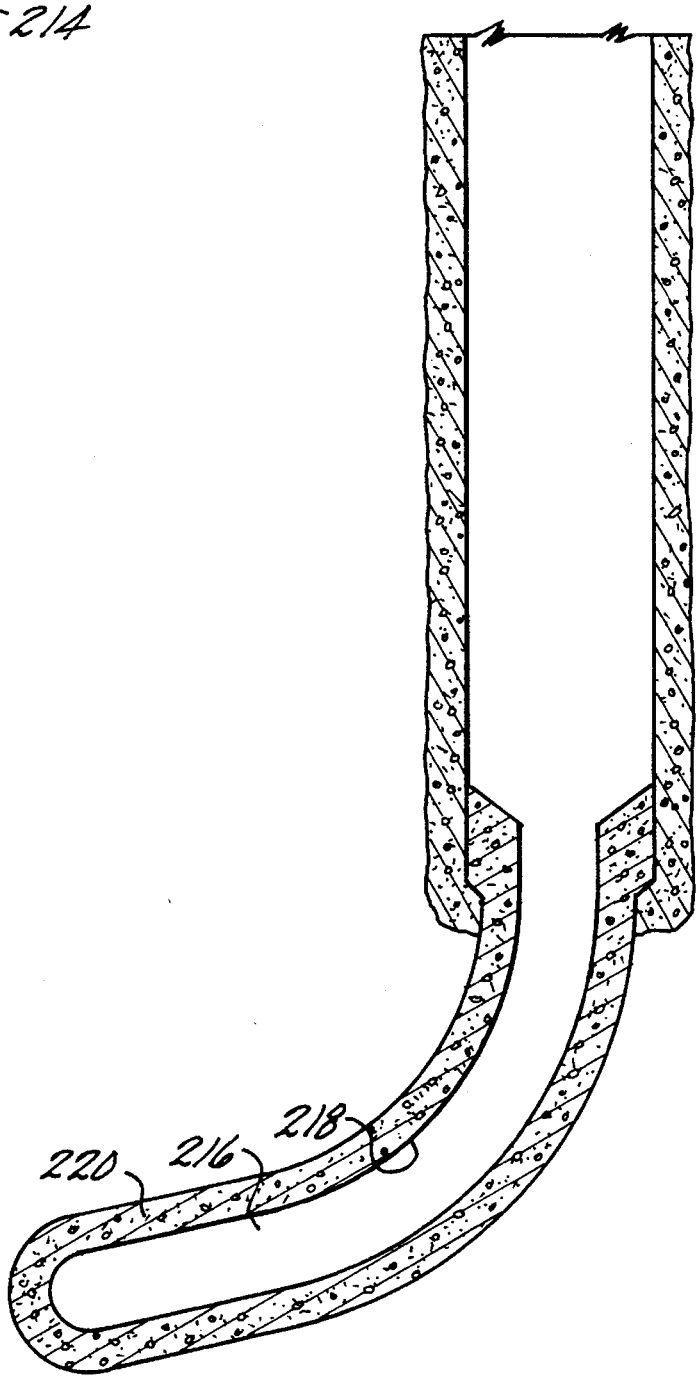

In FIG. 2A a primary well 210 is drilled and the casing 212 is run in and cement 214 is installed in known manner. In FIG. 2B a lateral wellbore #1, 216 is drilled off the bottom of primary wellbore 210 in a known manner. An appropriately sized liner 218 is cemented in place with cement 220, also in a known manner.

Figure 2C:
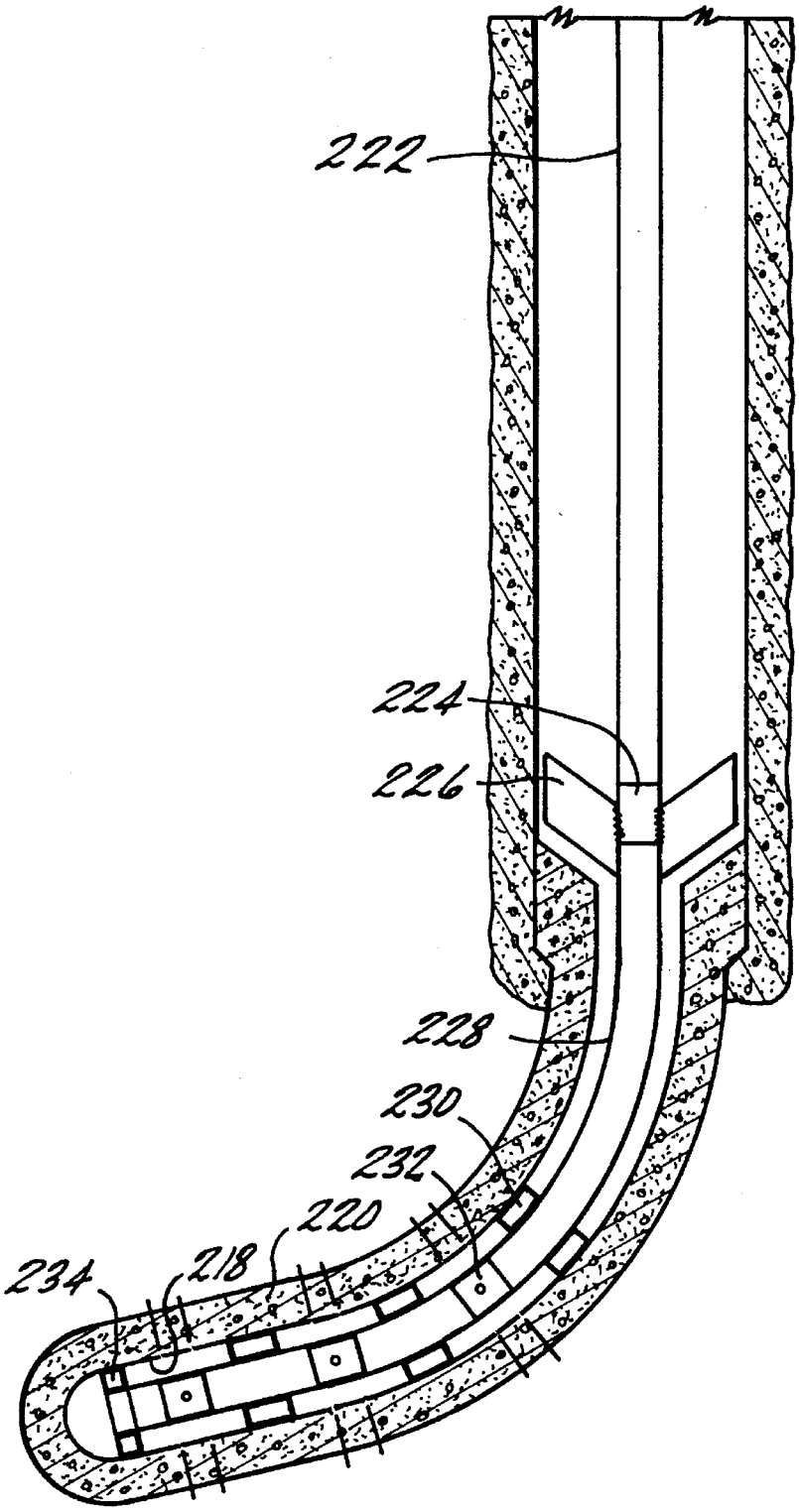

Referring now to FIG. 2C, a work string 222, is equipped with a running tool 224. Below the running tool 224 is an appropriately sized PBR (polished bore receptacle) seal bore 226. Following the seal bore 226 is standard appropriately sized tubing 228 equipped with a multiplicity of appropriately sized ISO packers 230 and a multiplicity of sliding sleeves 232 ending in a standard bottom packer 234. The liner 218 and the liner cementation 220 has been previously perforated and completed by known standard completion methods.

Figure 2D:
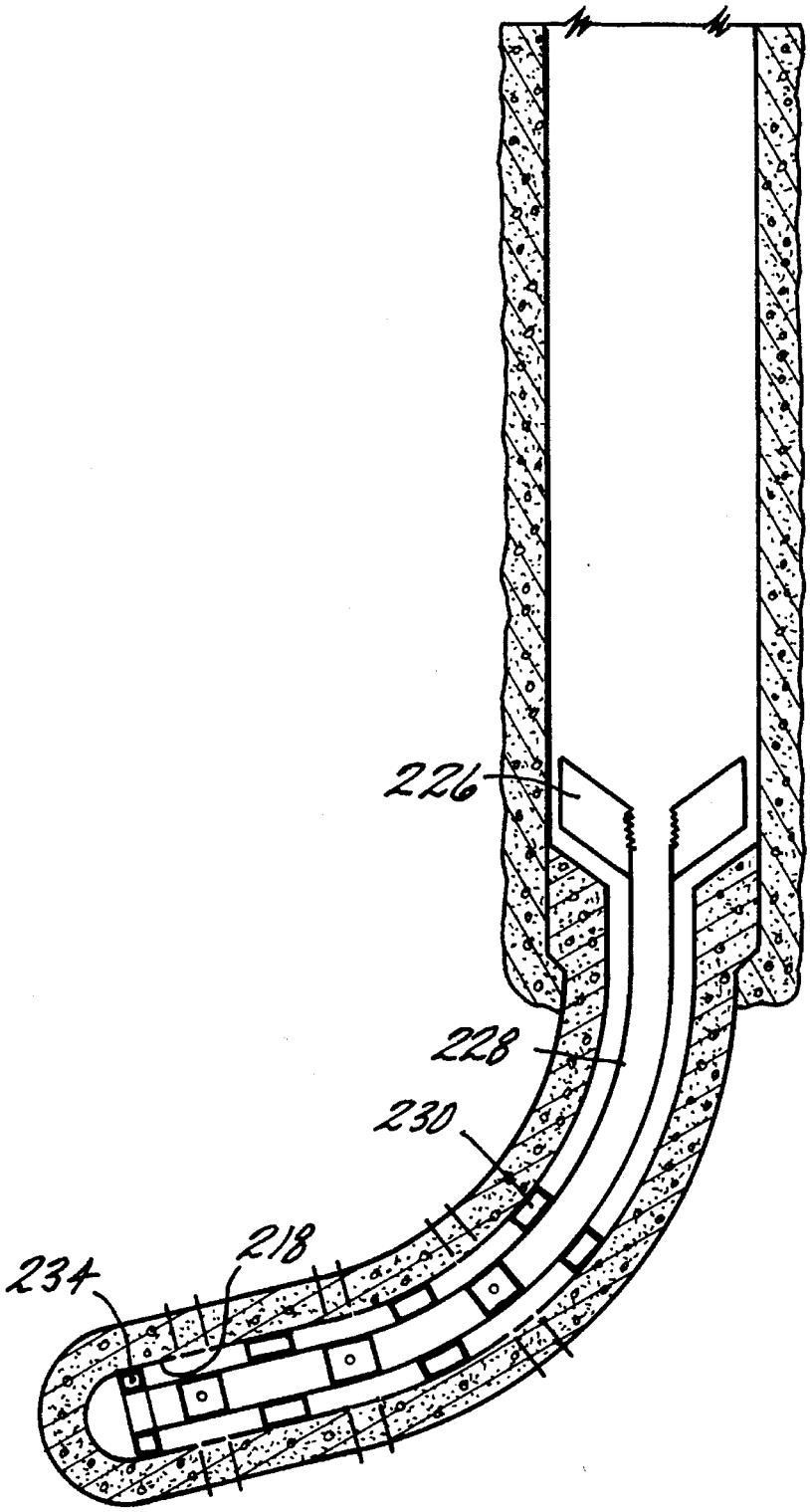
Figure 2E:
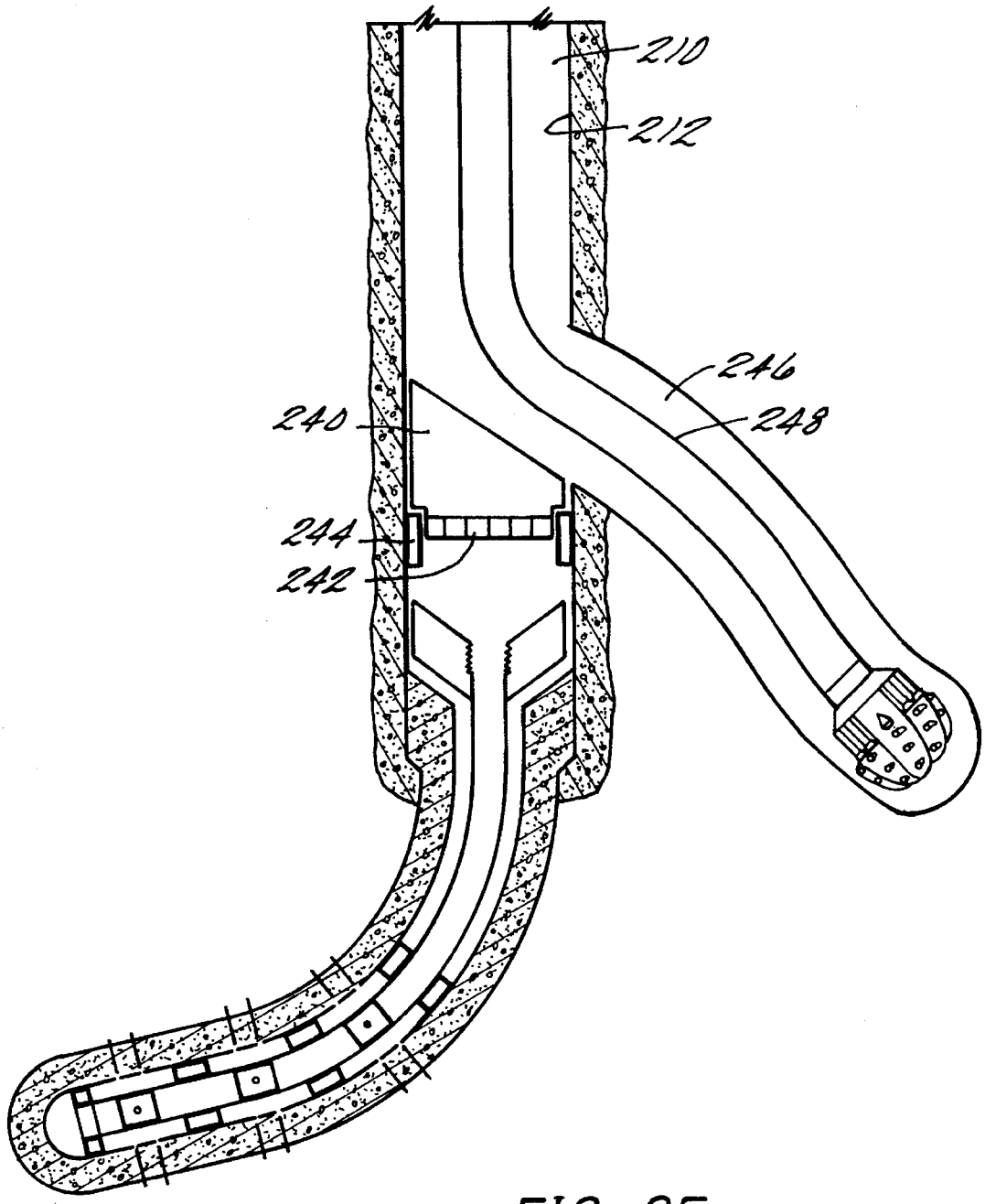

In FIG. 2D, the work string 222 (not shown) has retrieved the running tool 224 (not shown). Referring now to FIG. 2E, a retrievable whipstock 240 along with whipstock orientation anchor 242 and whipstock packer 244 are run into primary wellbore 210 and fixed to casing 212 at the desired depth at which it is desired to drill lateral wellbore 22 designated as 246. Lateral wellbore 246 (lateral #2) is drilled with drill string 248 in a known manner.

Figure 2F:
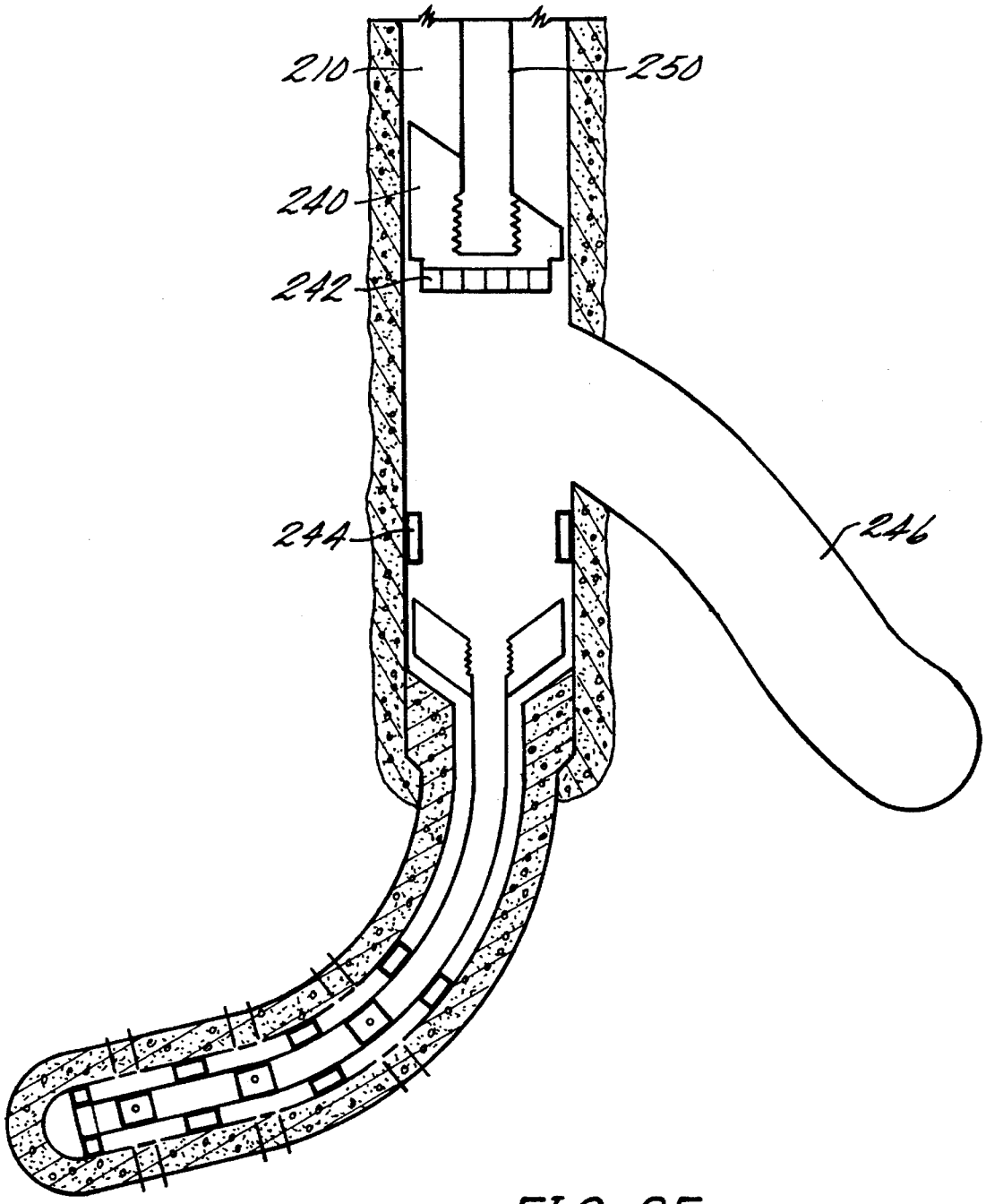

As seen in FIG. 2F, retrieving tool 250 withdraws retrievable whipstock 240 and whipstock orientation anchor 242 from primary wellbore 210. Whipstock packer 244 becomes the reference point for the completion of lateral wellbore 246 (lateral wellbore #2).

Figure 2G:
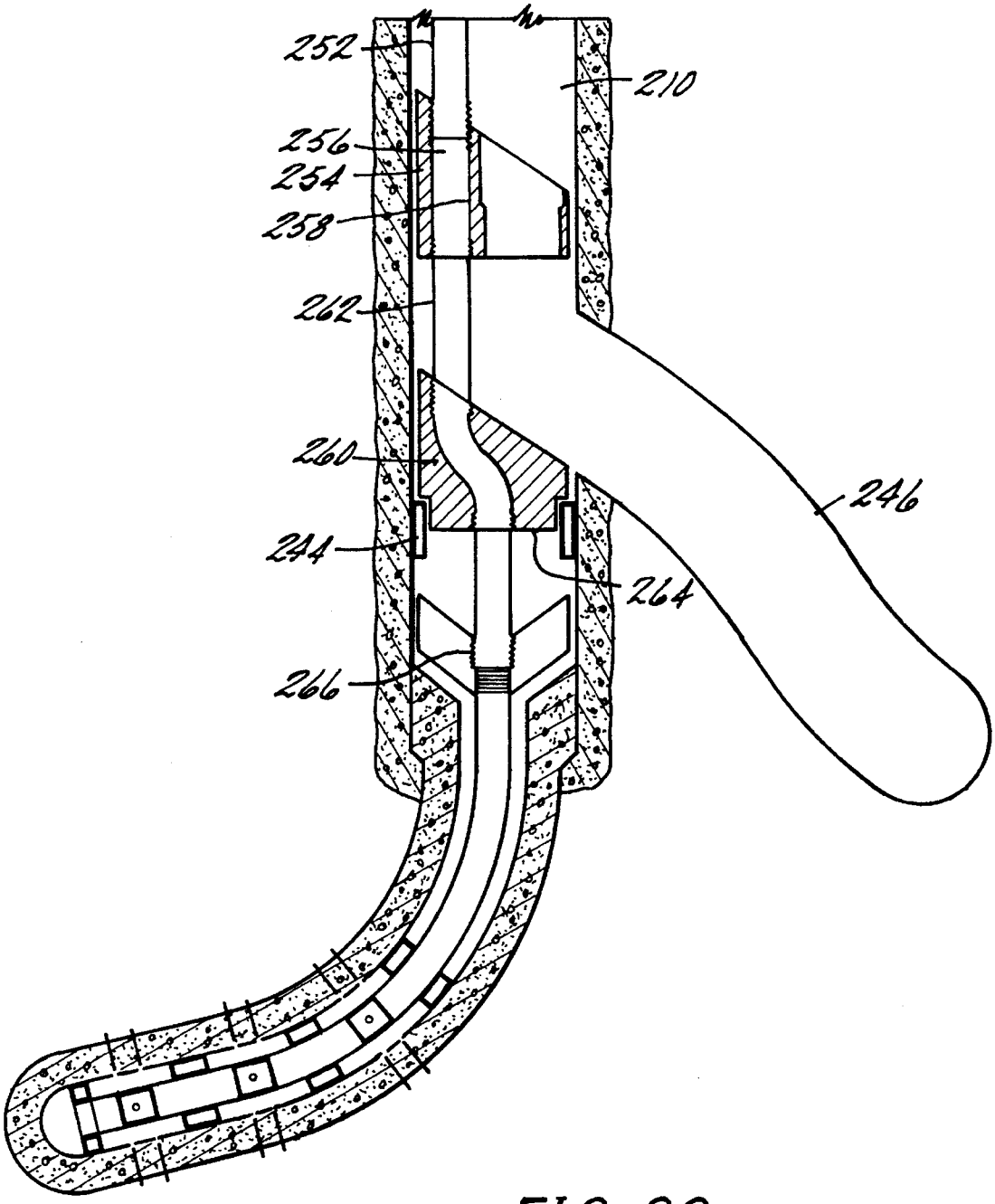

Turning now to FIG. 2G, which is similar in many respects to previously discussed FIG. 1M. A running tool 252 has the following equipment attached to it. A parallel scoop head 254, which contains a seal bore 256 which has a locating shoulder 258 that is capable of landing a liner (not shown). It should be noted that the aforementioned parallel scoop head 254 is located just above the juncture of lateral wellbore 246 (lateral #2) and primary wellbore 210. Below parallel scoop head 254 and above diverter sub 260 is a guide tube 262. At the bottom of diverter sub 260 is an orientation anchor 264. Attached to the bottom of diverter sub 260 is a combination extension and locator seal assembly 266. The scoop head assembly 254, guide tube 262, diverter sub 260, locator seal assembly 266, together with their attachments and seals are run into primary wellbore 210 and set and seated with the aid of whipstock packer 244. At the completion of this operation, the seals are tested for leak-tightness and the final step as depicted in FIG. 2G is to retrieve the running tool 252.

Figure 2H:
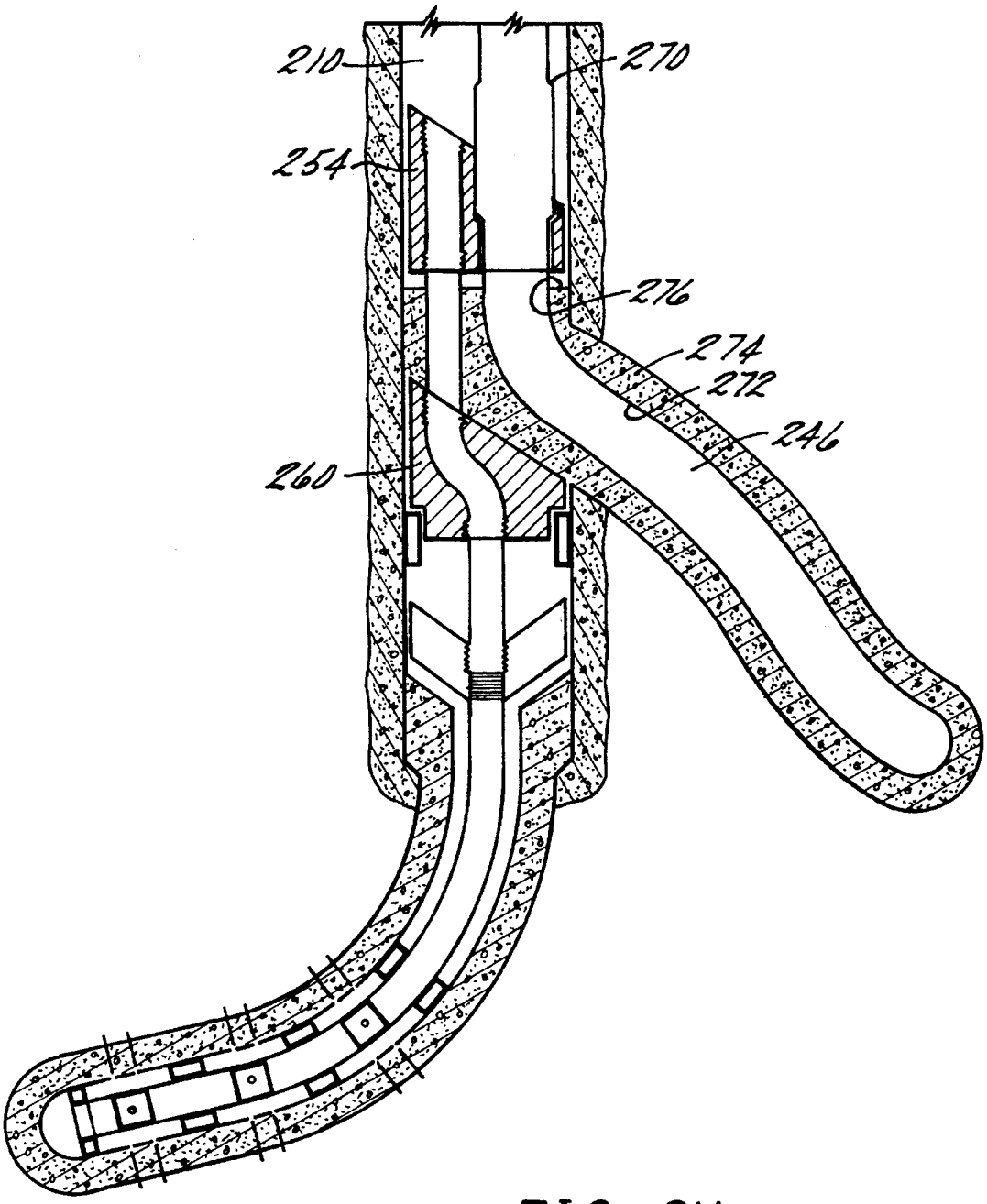

Referring now to FIG. 2H, an appropriately sized liner 272 is run into the parallel scoop head 254 into lateral wellbore 246 (lateral #2) at the end of hydraulic release liner running tool 270. The juncture between parallel scoop head 254, and diverter sub 260 located in primary wellbore 210 and lateral wellbore 246 (lateral wellbore #2) are cemented with cement 274 using conventional known cementing methods. It should be noted that parallel scoop head 254 should be in a vertical or substantially vertical section of the primary wellbore 210 so that the level 276 of cement 274 can be controlled to be below parallel scoop head 254 but at level 276, to completely seal the juncture between main wellbore 210 and lateral wellbore 246 and that level 276 be within the main wellbore 210.

Figure 21:
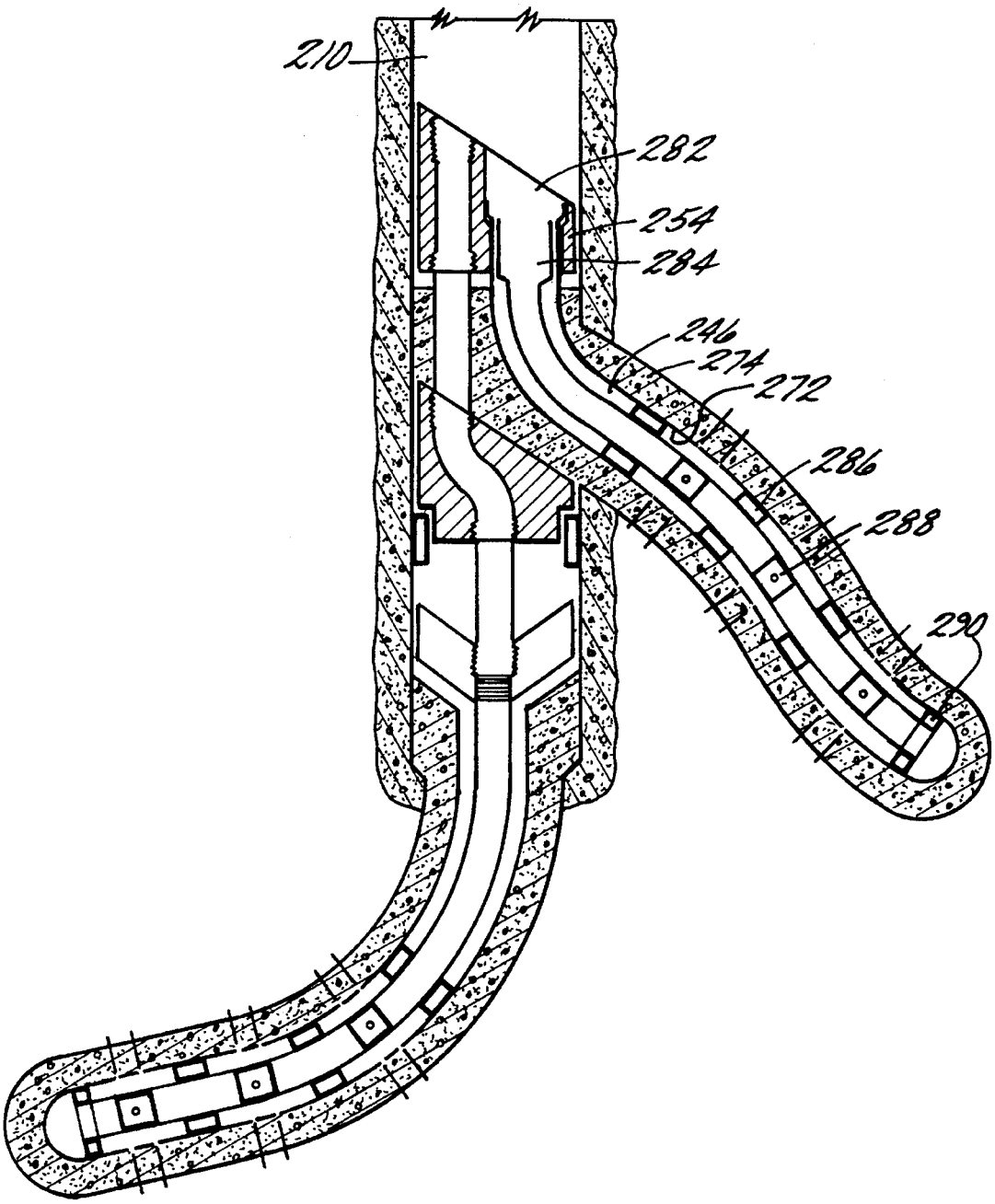

In FIG. 21, completion of lateral wellbore 246 (lateral wellbore #2) is done as follows: Firstly, a workstring 280 (not shown) is run into primary wellbore 210 which is equipped with known tools to perforate the liner 272 and the cement 274 of lateral wellbore 246, guided through the right hand bore 282 of parallel scoop head 254 in a known manner. After the perforation operation is completed, workstring 280 is withdrawn from lateral wellbore 246 and primary wellbore 210. The lateral wellbore 246 is then completed by running an appropriately sized seal bore assembly 284 which has a multiplicity of ISO packers 286 and a multiplicity of standard sliding sleeves 288 ending in a standard bottom packer 290. The seal bore 284 is seated in the right hand bore 282 of the parallel scoop head 254.

Figure 2J:
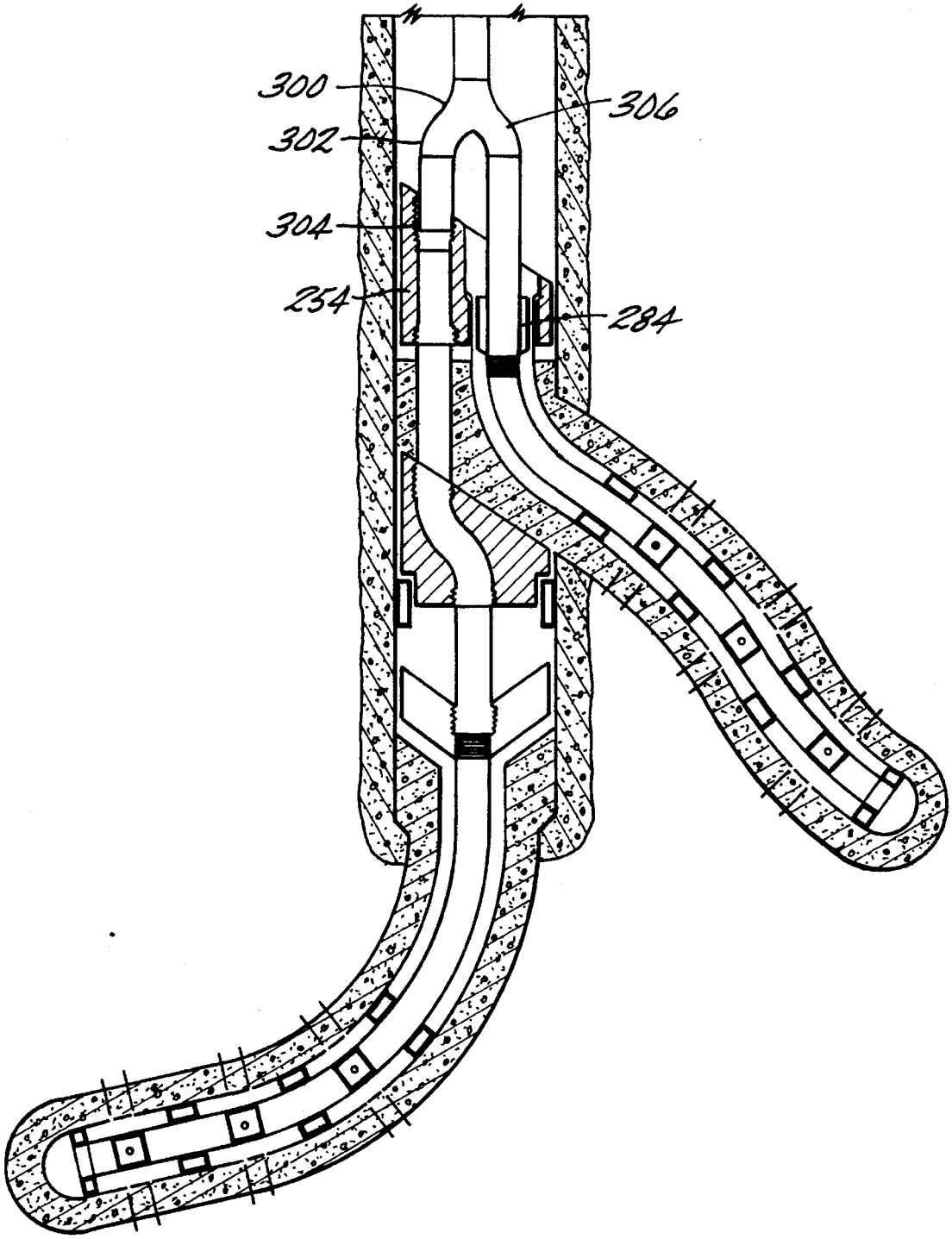

The final step, as depicted in FIG. 2J, for completion is to run a selective re-entry tool 300 whose left inverted "Y" branch 302 is connected and seated into the left side seal bore 304 of parallel scoop head 354. The right inverted "Y" branch 306 is connected sealingly tight to the seal bore 384. This procedure maintains the ability to perform any function that could be done in a single wellbore such as zonal isolation, stimulation or any other desired function.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A method for cementing a multilateral wellbore which includes a primary wellbore and at least one lateral wellbore comprising the steps of:

a) delivering a liner into said lateral wellbore;

b) delivering to the lateral wellbore a cementing assembly, said cementing assembly including cement delivering structure and a first plug having a flow opening therethrough wherein cement from said cement delivery structure flows through said flow opening and into said liner to an annulus defined by a space between said liner and said lateral wellbore;

c) delivering a second plug to said lateral wellbore wherein said second plug mates with the first plug to block said flow opening and define a plug assembly;

d) delivering fluid to said lateral borehole to pressurize said plug assembly and thereby disengage said plug assembly from said cementing assembly wherein said plug assembly plugs said liner; and e) removing the cementing assembly.

2. A method for cementing a multilateral wellbore as claimed in claim 1 wherein said cement flows to the annulus through an aperture at a distal end of the liner.

3. A method for cementing a multilateral wellbore as claimed in claim 2 wherein the aperture is axially aligned with the liner.

4. A method for cementing a multilateral wellbore as claimed in claim 1 wherein the cementing assembly is maintained in a predetermined position within the lateral wellbore by an external casing packer.

5. A method for cementing a multilateral wellbore as claimed in claim 4 wherein the external casing packer is inflated by a fluid delivered down hole by a work string.

6. A method for cementing a multilateral wellbore as claimed in claim 5 wherein a pressure increase to inflate the external casing packer is occasioned by a tripping ball seating in a ball seat sub contained within the cementing assembly.

7. A method for cementing a multilateral wellbore as claimed in claim 6 wherein the tripping ball is dropped from the surface at a predetermined time.

8. A method for cementing a multilateral wellbore as claimed in claim 2 wherein the cement flowing through the aperture flows around said liner creating a contiguous annular concrete layer from the aperture to an external casing packer.

9. A method for cementing a multilateral wellbore as claimed in claim 8 wherein the external casing packer prevents the flow of cement in a proximal direction.

10. A method for cementing a multilateral wellbore as claimed in claim 1 wherein cement is provided to the cementing assembly through a workstring from the surface.

11. A method for cementing a multilateral wellbore as claimed in claim 1 wherein cementitious material from the surface is a preselected amount, said amount coinciding with an amount necessary to fill the annulus between an aperture in the distal end of the liner and an external casing packer.

12. A method for cementing a multilateral wellbore as claimed in claim 1 wherein said plug assembly is jettisoned at a selected time to move along with the flow of cement to a landing collar whereby the plug assembly become seated in the landing collar to plug said liner.

13. A method for cementing multilateral wellbore as claimed in claim 1 including completing a multilateral wellbore wherein subsequent to removing the cementing assembly a perforation device is positioned within the lateral wellbore to perforate the liner and cement annular and is then removed whereby desired materials may be accessed by the wellbore.

14. A method for cementing a multilateral wellbore as claimed in claim 1 including completing a multilateral wellbore wherein said cementing assembly includes a polished bore receptacle for creating sealed engagement with various assemblies run in on a work string.

15. A method for cementing multilateral wellbore as claimed in claim 13 wherein the perforation device is a TCP gun assembly.

16. A method for cementing a multilateral wellbore as claimed in claim 14 wherein a further step comprises placing a parallel scoop head in position above the origin of the lateral wellbore and a diverter sub below that origin along with a tube connecting one aperture of the scoop head to an aperture in the diverter sub.

17. A method for cementing a multilateral wellbore as claimed in claim 15 wherein a further step comprises positioning a safety valve/selective re-entry tool in fluid communication with an aperture in the parallel scoop head whereby the wellbore is fully operational.

18. A method of cementing a multilateral wellbore as claimed in claim 1 wherein a further step comprises cementing the juncture between the primary wellbore and the lateral wellbore by pumping cement through said liner and into an annulus defined by the liner and an earthen wall of the wellbore until the cement has reached a level within the primary wellbore which is above the juncture opening of the lateral and lower than a bottom surface of the scoop head.

* * * * *